US009891549B2

(12) United States Patent
Seki

(10) Patent No.: US 9,891,549 B2
(45) Date of Patent: Feb. 13, 2018

(54) LIGHT SCANNING APPARATUS, IMAGE FORMING APPARATUS, AND METHOD OF MANUFACTURING LIGHT SCANNING APPARATUS

(71) Applicant: CANON KABUSHIKI KAISHA, Tokyo (JP)

(72) Inventor: Yuichi Seki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/255,889

(22) Filed: Sep. 2, 2016

(65) Prior Publication Data

US 2017/0075250 A1 Mar. 16, 2017

(30) Foreign Application Priority Data

Sep. 10, 2015 (JP) ..... 2015-178208

(51) Int. Cl.
*G03G 15/04* (2006.01)
*G03G 15/043* (2006.01)

(52) U.S. Cl.
CPC ..... *G03G 15/043* (2013.01); *G03G 15/0409* (2013.01)

(58) Field of Classification Search
CPC ..... G03G 15/043; G03G 15/0409
See application file for complete search history.

(56) References Cited

U.S. PATENT DOCUMENTS 6,560,256 B1 5/2003 Seki et al. ..... 372/38.02
6,919,979 B2 7/2005 Seki et al. ..... 359/204.1
7,106,770 B2 9/2006 Seki ..... 372/43.01
7,129,967 B2 10/2006 Seki et al. ..... 347/249
7,345,695 B2 3/2008 Suzuki ..... 347/235
7,586,511 B2 9/2009 Seki et al. ..... 347/249
7,673,981 B2 * 3/2010 Matsuyama ..... B41J 2/0057 347/103
8,963,978 B2 2/2015 Seki ..... 347/237
9,091,955 B2 7/2015 Seki ..... G03G 15/04072
9,229,355 B2 * 1/2016 Nito ..... G03G 15/043

FOREIGN PATENT DOCUMENTS

JP 2002-258182 9/2002

OTHER PUBLICATIONS

U.S. Appl. No. 15/345,114, filed Nov. 7, 2016.
U.S. Appl. No. 15/229,069, filed Aug. 4, 2016.

* cited by examiner

*Primary Examiner* — Hoang Ngo
(74) *Attorney, Agent, or Firm* — Fitzpatrick, Cella, Harper & Scinto

(57) ABSTRACT

A light scanning apparatus, including: a light source configured to emit a light beam; a rotary polygon mirror configured to deflect the light beam emitted from the light source so that the light beam scans on a surface of a photosensitive member in a main scanning direction; a motor configured to rotate the rotary polygon mirror; and a rotational position detection unit configured to detect a magnetic flux change caused by rotation of the motor to generate a rotational position detection signal, wherein an emitting start timing of the light beam from the light source is determined based on the rotational position detection signal in order to maintain a writing start position of the light beam with respect to the photosensitive member in the main scanning direction.

10 Claims, 15 Drawing Sheets

LIGHT SCANNING APPARATUS, IMAGE FORMING APPARATUS, AND METHOD OF MANUFACTURING LIGHT SCANNING APPARATUS

BACKGROUND OF THE INVENTION

Field of the Invention

The present invention relates to a light scanning apparatus including a rotary polygon mirror, to an image forming apparatus including the light scanning apparatus, and to a method of manufacturing the light scanning apparatus.

Description of the Related Art

Hitherto, an electrophotographic image forming apparatus includes a light scanning apparatus. The light scanning apparatus is configured to deflect a light beam emitted from a light source with the use of a rotary polygon mirror. The deflected light beam is scanned on a photosensitive drum through an fθ lens, to thereby form an electrostatic latent image.

The image forming apparatus needs to determine an emitting start timing of a light beam in order to keep a writing start position of an image at a fixed position in a main scanning direction. In order to determine the emitting start timing of the light beam, the light scanning apparatus generally includes a light beam detector (hereinafter referred to as "BD"). The BD is configured to output a BD signal when the BD receives the light beam emitted from the light source and deflected by the rotary polygon mirror. The image forming apparatus is configured to determine the emitting start timing of the light beam based on the BD signal. However, in order to enable the BD to generate the BD signal, optical components such as a condeser lens and a slit configured to allow the light beam to enter the BD are required in addition to the BD. Therefore, there arises a problem in that the number of components and the assembly man-hours are increased, to thereby raise the cost.

In the aim of solving this problem, there is disclosed in U.S. Pat. No. 7,345,695 that the emitting start timing of the light beam is determined, without use of the BD, by detecting a reference mark arranged on the rotary polygon mirror or on a member integrally rotated with the rotary polygon mirror.

However, the arrangement of the reference mark and a detector configured to detect the reference mark still poses the problem in that the number of components and the assembly man-hours are increased, to thereby raise the cost.

SUMMARY OF THE INVENTION

In view of the above, the present invention provides a light scanning apparatus configured to determine an emitting start timing of a light beam based on a rotational position detection signal generated in accordance with rotation of a motor configured to rotate a rotary polygon mirror, an image forming apparatus including the light scanning apparatus, and a method of manufacturing the light scanning apparatus.

In order to solve the above-mentioned problems, according to one embodiment of the present invention, there is provided a light scanning apparatus, comprising:

a light source configured to emit a light beam;

a rotary polygon mirror configured to deflect the light beam emitted from the light source so that the light beam scans on a surface of a photosensitive member in a main scanning direction;

a motor configured to rotate the rotary polygon mirror; and a rotational position detection unit configured to detect a magnetic flux change caused by rotation of the motor to generate a rotational position detection signal, wherein an emitting start timing of the light beam from the light source is determined based on the rotational position detection signal in order to maintain a writing start position of the light beam with respect to the photosensitive member in the main scanning direction.

According to one embodiment of the present invention, there is provided an image forming apparatus including the light scanning apparatus.

According to one embodiment of the present invention, there is provided a method of manufacturing the light scanning apparatus.

Further features of the present invention will become apparent from the following description of exemplary embodiments with reference to the attached drawings.

DESCRIPTION OF THE EMBODIMENTS

Now, the embodiments of the present invention will be described referring to the accompanying drawings.

First Embodiment

Image Forming Apparatus

Figure 19:
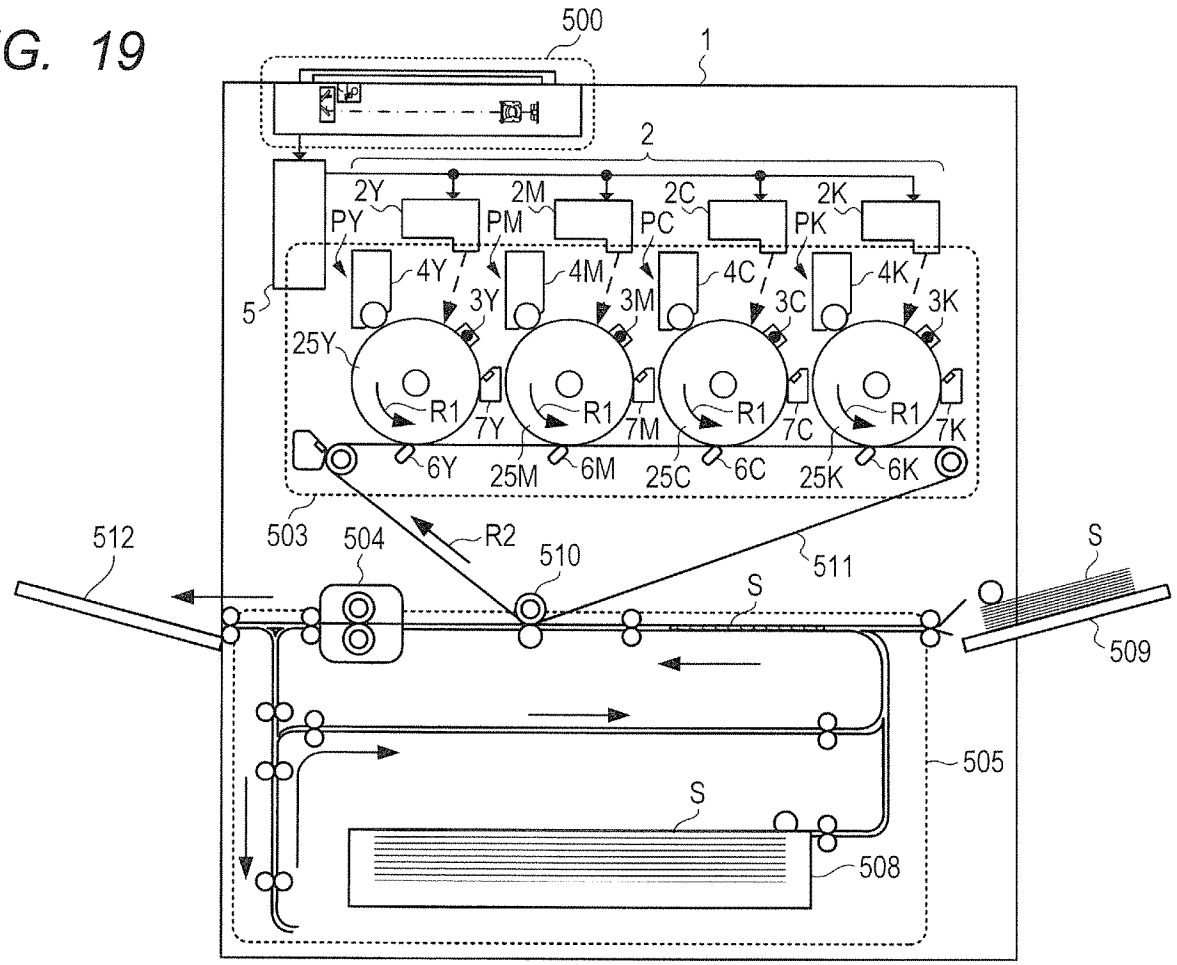
FIG. 19 is a sectional view of an image forming apparatus according to the first embodiment.

An electrophotographic image forming apparatus 1 according to a first embodiment will be described. FIG. 19 is a sectional view of the image forming apparatus 1 according to the first embodiment. The image forming apparatus 1 includes light scanning apparatus 2 (2Y, 2M, 2C, and 2K), an image control portion 5, an image reading portion 500, an image forming portion 503 having photosensitive drums (photosensitive members) 25, a fixing portion 504, and a sheet feeding and conveying portion 505. The image reading portion 500 is configured to illuminate an original placed on an original platen, optically read an image of the original, and convert the read image into image data (electric signal). The image control portion 5 is configured to receive the image data from the image reading portion 500 and convert the received image data into an image signal. The image control portion 5 is further configured to transmit the image signal to the light scanning apparatus 2 and control emission of light from the light scanning apparatus 2.

The image forming portion 503 includes four image forming stations P (PY, PM, PC, and PK). The four image forming stations P are arranged in the order of yellow (Y), magenta (M), cyan (C), and black (K) along a rotation direction R2 of an endless intermediate transfer belt (hereinafter referred to as "intermediate transfer member") 511. The image forming stations P include photosensitive drums (photosensitive members) 25 (25Y, 25M, 25C, and 25K), respectively, serving as image bearing members rotated in a direction indicated by arrows R1. Around the photosensitive drums 25, there are arranged chargers (charging units) 3, the light scanning apparatus 2, developing devices (developing units) 4, primary transfer members 6 (6Y, 6M, 6C, and 6K), and cleaning devices 7 (7Y, 7M, 7C, and 7K), respectively, along the rotation direction R1.

The chargers 3 (3Y, 3M, 3C, and 3K) are configured to uniformly charge surfaces of the rotating photosensitive drums 25 (25Y, 25M, 25C, and 25K), respectively. The light scanning apparatus 2 (2Y, 2M, 2C, and 2K) are configured to emit light beams modulated in accordance with image signals, to thereby form electrostatic latent images on the surfaces of the photosensitive drums 25 (25Y, 25M, 25C, and 25K). The developing devices 4 (4Y, 4M, 4C, and 4K) are configured to develop the electrostatic latent images formed on the photosensitive drums 25 (25Y, 25M, 25C, and 25K) with toner (developer) of respective colors, to thereby form toner images. The primary transfer members 6 (6Y, 6M, 6C, and 6K) are configured to perform primary transfer of the toner images on the photosensitive drums 25 (25Y, 25M, 25C, and 25K) sequentially onto the intermediate transfer member 511 to superimpose the images one on another. The cleaning devices 7 (7Y, 7M, 7C, and 7K) are configured to collect residual toner on the photosensitive drums 25 (25Y, 25M, 25C, and 25K) after the primary transfer.

A recording medium (hereinafter referred to as "sheet") S is conveyed from a sheet feeding cassette 508 of the sheet feeding and conveying portion 505 or from a manual feeding tray 509 to a secondary transfer roller 510. The secondary transfer roller 510 is configured to perform secondary transfer of collectively transferring the toner images on the intermediate transfer member 511 onto the sheet S. The sheet S having the toner images transferred thereon is conveyed to the fixing portion 504. The fixing portion 504 is configured to heat and press the sheet S to melt the toner, to thereby fix the toner image onto the sheet S. With this, a full-color image is formed on the sheet S. The sheet S having the image formed thereon is delivered to a delivery tray 512.

The light scanning apparatus 2 (2Y, 2M, 2C, and 2K) are configured to start emission of light beams for magenta, cyan, and black images sequentially from an emitting start timing of a light beam for a yellow image. The emitting start timings of the light scanning apparatus 2 in a sub-scanning direction are controlled so that a full-color toner image having no color misregistration is transferred onto the intermediate transfer member 511.

(Light Scanning Apparatus)

Figure 2:
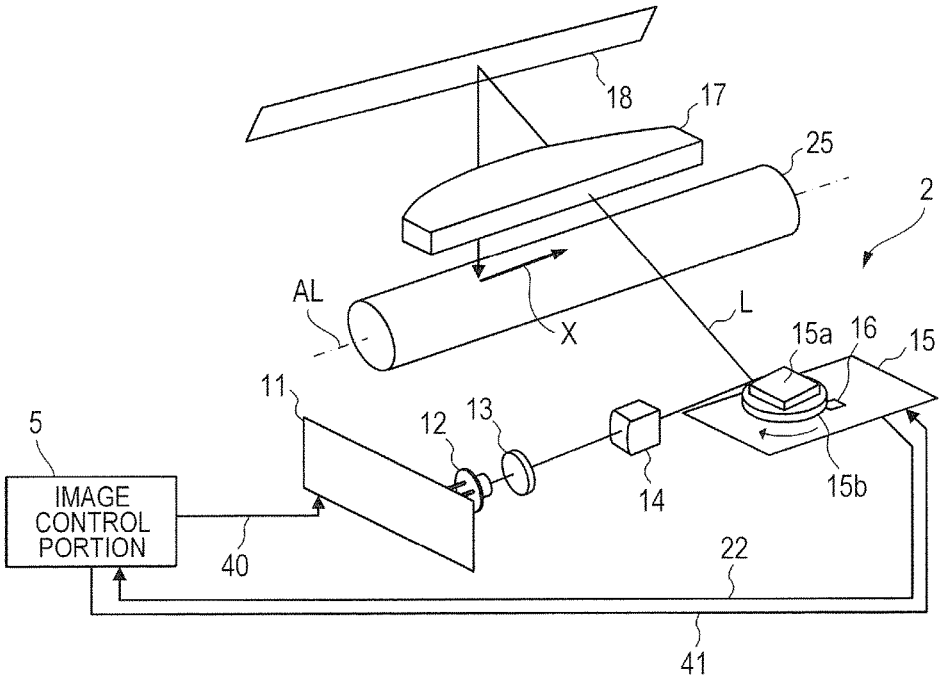
FIG. 2 is an explanatory view of a light scanning apparatus according to the first embodiment.

FIG. 2 is an explanatory view of the light scanning apparatus 2 according to the first embodiment. The light scanning apparatus 2 includes a laser control portion 11, a semiconductor laser (light source) 12, a collimator lens 13, a cylindrical lens 14, a motor 15, an fθ lens 17, and a reflection mirror 18. The motor 15 includes a rotor 15*b*. A rotary polygon mirror 15*a* is integrally rotated with the rotor 15*b*. In the embodiment, the image control portion 5 is arranged outside the light scanning apparatus 2 and inside a main body of the image forming apparatus 1. The image control portion 5 and the light scanning apparatus 2 are electrically connected to each other. The image control portion 5 may be arranged in the light scanning apparatus 2. Laser light (hereinafter referred to as "light beam") L emitted from the semiconductor laser 12 passes through the collimator lens 13 and the cylindrical lens 14 to reach the rotary polygon mirror 15*a*. The light beam L is deflected by the rotary polygon mirror 15*a*, passes through the fθ lens 17 and the reflection mirror 18, and is scanned on the photosensitive drum 25 in the main scanning direction indicated by an arrow X, to thereby form an electrostatic latent image. In the light scanning apparatus 2 according to the embodiment, a light beam detector (BD) configured to output a BD signal for controlling an emitting start timing of the light beam L for forming the electrostatic latent image in an image region on the photosensitive drum 25 is not arranged.

(Motor)

Figure 1A:
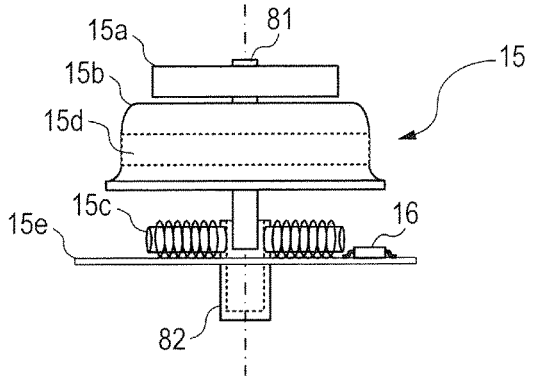
FIG. 1A, FIG. 1B, and FIG. 1C are explanatory views of a motor according to a first embodiment of the present invention.
Figure 1B:
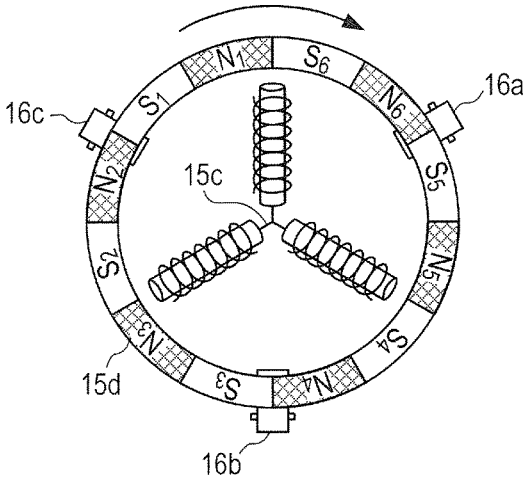
Figure 1C:
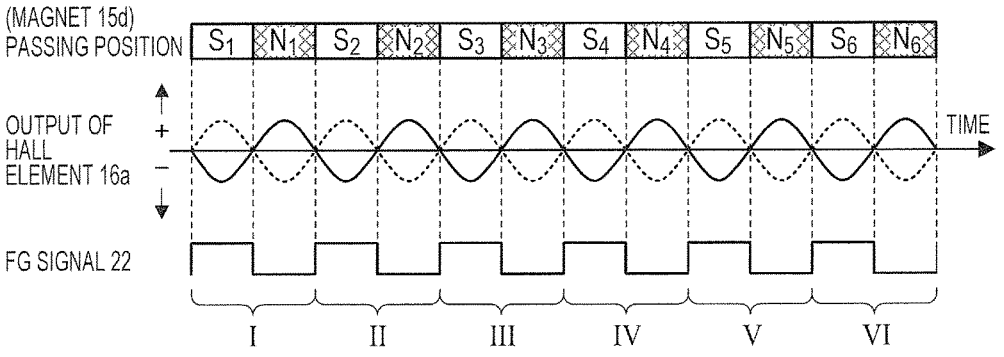

FIG. 1A, FIG. 1B, and FIG. 1C are explanatory views of the motor 15 according to the first embodiment. FIG. 1A is a transverse sectional view of the motor 15 according to the first embodiment. The motor (deflection unit) 15 is a three-phase six-pole brushless DC motor. The numbers of phases and poles of the motor 15 are not limited to three phases and six poles. The rotary polygon mirror 15*a* includes four reflection surfaces (deflection surfaces). The number of the reflection surfaces of the rotary polygon mirror 15*a* is not limited to four surfaces.

The rotary polygon mirror 15*a* and the rotor 15*b* are integrally fixed by a motor shaft 81. In an interior of the rotor 15*b* as indicated by the broken lines in FIG. 1A, magnets (permanent magnets) 15*d* having six pairs of magnetic poles arranged therein are mounted on an inner circumferential surface of the rotor 15*b*. In FIG. 1A, a position of the rotor 15*b* with respect to a motor control board 15*e* is illustrated as being higher than an actual position for convenience of description only. A motor shaft bearing 82 is configured to rotatably support the motor shaft 81 fixed to the rotor 15*b*. A winding 15*c* includes three slots (coils) arranged on the motor control board 15*e* so as to drive a three-phase current. There is only one Hall element 16 illustrated in FIG. 1A. However, in reality, Hall elements 16*a*, 16*b*, and 16*c* corresponding to the number of (three) slots of the winding 15*c* are arranged as illustrated in FIG. 1B.

FIG. 1B is a view for illustrating the winding 15*c*, the magnets 15*d*, and the Hall elements (rotational position detection units) 16 (16*a*, 16*b*, and 16*c*). FIG. 1C is a time chart for illustrating passing positions of the magnets 15*d*, output of the Hall element 16*a*, and rotational position detection signals (hereinafter referred to as "FG signal") 22 when the rotor 15*b* is rotated in a clockwise direction. The Hall element 16*a* is configured to convert a magnetic flux change caused by rotation of the rotor 15*b* into an electric signal and generate a (+) output indicated by the solid line and a (−) output indicated by the broken line. The FG signals 22 illustrated in FIG. 1C can be obtained from differential output of the Hall element 16*a*. The FG signals 22 can be determined from outputs of any one of the plurality of Hall elements 16*a*, 16*b*, and 16*c*. Thus, in the following description, any one of the plurality of Hall elements 16*a*, 16*b*, and 16*c* is described as the Hall element 16. In the embodiment, the Hall element 16 is used as a rotational position detection unit. However, instead of using the Hall element 16, the FG signals 22 can also be generated through use of a magnetic pattern or a rectangular detection pattern for detection of the magnetic flux change caused by rotation of the rotor 15*b*.

The FG signals 22 are output from the Hall element 16 arranged in the motor 15. The motor control board 15*e* is configured to detect positions of the magnetic poles of the magnets 15*d* arranged in the rotor 15*b* based on the FG signals 22 and switch current flowed to the three slots of the winding 15*c*, to thereby rotate the motor 15. The image control portion 5 determines, based on the FG signal 22, an emitting start timing (light exposure start timing) for starting emission of the light beam L from the semiconductor laser 12. Herein, the emitting start timing is a timing at which the semiconductor laser 12 starts emission of the light beam L in accordance with an image signal 40 to keep a writing start position of an image at a fixed position in a main scanning direction X. The main scanning direction X is a direction parallel to a rotational axis line AL of the photosensitive drum 25. The image control portion 5 is configured to output the image signal 40 to the laser control portion (light source control portion) 11 in accordance with the emitting start timing. That is, the image control portion 5 can sequentially output image signals 40 to the laser control portion 11 at timings of outputting the FG signals 22. In the first embodiment, the FG signal serves as a synchronization signal for the light beam L in the main scanning direction to keep a writing start position of an image at a fixed position in the main scanning direction.

According to the first embodiment, the image control portion 5 can determine, based on the FG signal 22 output from the Hall element 16 of the motor 15, the emitting starting timing at which the semiconductor laser 12 starts emission of the light beam L. According to the first embodiment, a BD and optical components configured to cause a light beam to enter the BD are not required, thereby being capable of reducing the cost.

Second Embodiment

Figure 3:
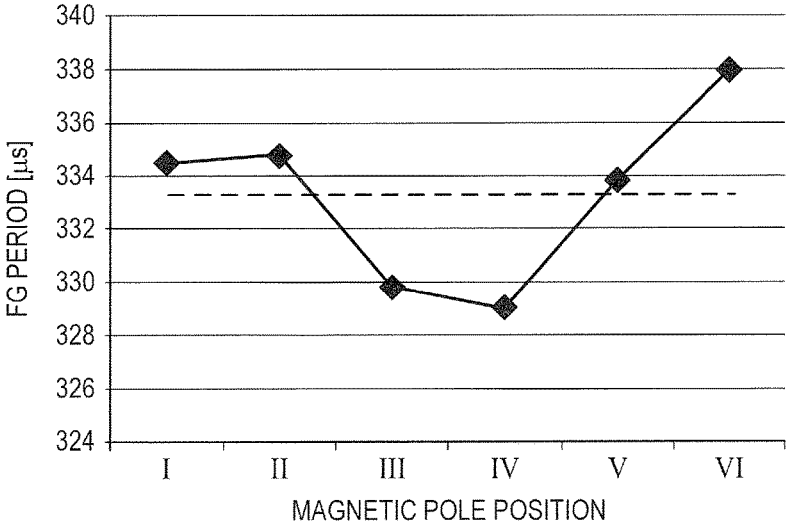
FIG. 3 is a graph for showing variance in periods of FG signals according to a second embodiment of the present invention.

Next, a second embodiment will be described. In the second embodiment, configurations which are the same as those of the first embodiment are denoted by the same reference symbols, and description thereof is omitted. The image forming apparatus 1, the motor 15, and the light scanning apparatus 2 according to the second embodiment are the same as those of the first embodiment, and hence description thereof is omitted. FIG. 3 is a graph for showing variance in periods of the FG signals 22 according to the second embodiment. The solid line represents measured values of the periods of the FG signals 22 with respect to magnetic pole positions I, II, III, IV, V, and VI when the motor 15 is rotated at a predetermined rotation speed. The broken line represents a theoretical value for the periods of the FG signals 22 with respect to the magnetic pole positions I, II, III, IV, V, and VI. The measured values of the periods of the FG signals 22 with respect to the magnetic pole positions I, II, III, IV, V, and VI have a variance of about 1% due to variance in magnetized positions of the magnets 15*d*. Thus, the magnetic pole positions I, II, III, IV, V, and VI can be identified by measuring each period of the FG signals 22.

Measured values of the periods of the FG signals 22 with respect to the magnetic pole positions I, II, III, IV, V, and VI during rotation of the motor 15 at a predetermined rotation speed are stored in advance in a memory of the image control portion 5 as a period pattern of the FG signals 22. During a preparation operation before starting image formation, the image control portion 5 can identify the magnetic pole positions I, II, III, IV, V, and VI by measuring the periods of the FG signals 22 and checking (matching) the measured periods against the period pattern stored in the memory (not shown). A relationship between the identified magnetic pole positions I, II, III, IV, V, and VI and orientations of certain reflection surfaces of the rotary polygon mirror 15*a* is determined in advance. The emitting start timing of the light beam with respect to each reflection surface of the rotary polygon mirror 15*a* can be identified in accordance with the relationship between the magnetic pole positions and the orientations of the reflection surfaces.

According to the second embodiment, the magnetic pole positions of the magnets 15*d* fixed to the rotor 15*b* can be identified by detecting the periods of the FG signal 22. The emitting start timing of the light beam with respect to each of the plurality of reflection surfaces of the rotary polygon mirror 15*a* can be determined based on the identified magnetic pole positions. Thus, precision in the emitting start timing of the light beam to keep a writing start position of an image at a fixed position in the main scanning direction can be improved.

Third Embodiment

Figure 4:
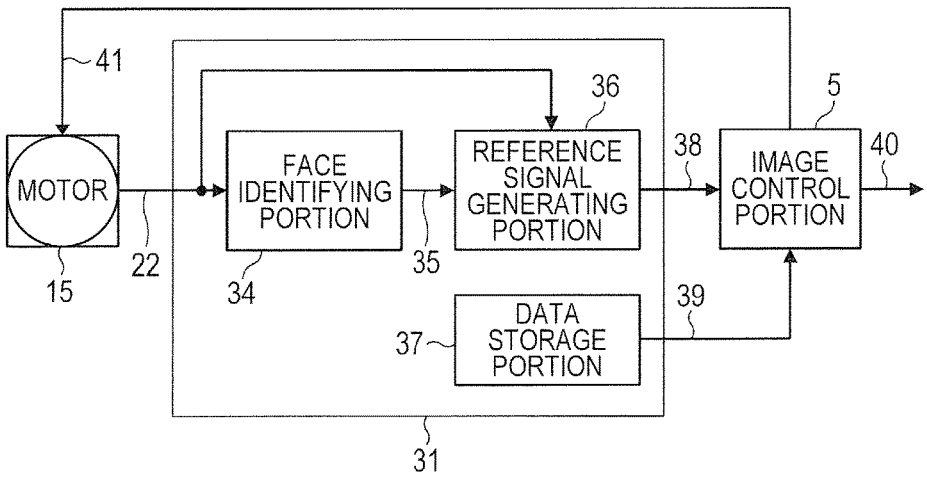
FIG. 4 is a block diagram of a writing start control portion according to a third embodiment of the present invention.

Next, a third embodiment will be described. In the third embodiment, configurations which are the same as those of the first embodiment have the same reference symbols allotted, and description thereof is omitted. The image forming apparatus 1, the motor 15, and the light scanning apparatus 2 according to the third embodiment are the same as those of the first embodiment, and hence description thereof is omitted. FIG. 4 is a block diagram of a writing start control portion 31 according to the third embodiment. The writing start control portion 31 includes a face identifying portion (identifying unit) 34, a reference signal generating portion (reference signal generating unit) 36, and a data storage portion (storage unit) 37. The motor 15 is configured to start rotation in accordance with a motor activation signal 41 output from the image control portion 5. The Hall element 16 of the motor 15 is configured to generate the FG signals 22 in accordance with the rotation of the motor 15. FG signals 22 are input to the face identifying portion 34 and the reference signal generating portion 36. The face identifying portion 34 is configured to measure the periods of the FG signals 22, identify the reflection surfaces based on a relationship between the measured periods and the reflection surfaces of the rotary polygon mirror 15*a*, and generate a face identification signal 35. Herein, the face identifying portion 34 serves as an identifying unit configured to identify the magnetic pole positions of the magnets 15*d* arranged in the rotor 15*b*. The face identifying portion 34 is configured to identify the reflection surfaces (deflection surfaces) of the rotary polygon mirror 15*a* by identifying the magnetic pole positions of the magnet 15*d* and output the face identification signals 35 as an identification result for the reflection surfaces. The reference signal generating portion 36 is configured to generate reference signals 38 based on the face identification signals 35 and the FG signals 22. The data storage portion 37 is configured to store phase data 39 having phase values representing a positional relationship of the reflection surfaces of the rotary polygon mirror 15*a* with respect to the reference signals 38. It is preferred that the phase data 39 include a plurality of pieces of data corresponding to the number of the reflection surfaces of the rotary polygon mirror 15*a*. It is preferred that the plurality of pieces of data included in the phase data 39 correspond to the plurality of reflection surfaces of the rotary polygon mirror 15*a*, respectively. The image control portion 5 is configured to determine, based on the reference signals 38 and the phase data 39, the emitting start timing for each reflection surface of the rotary polygon mirror 15*a* to keep a writing start position of an image at a fixed position in the main scanning direction.

Figure 5A:
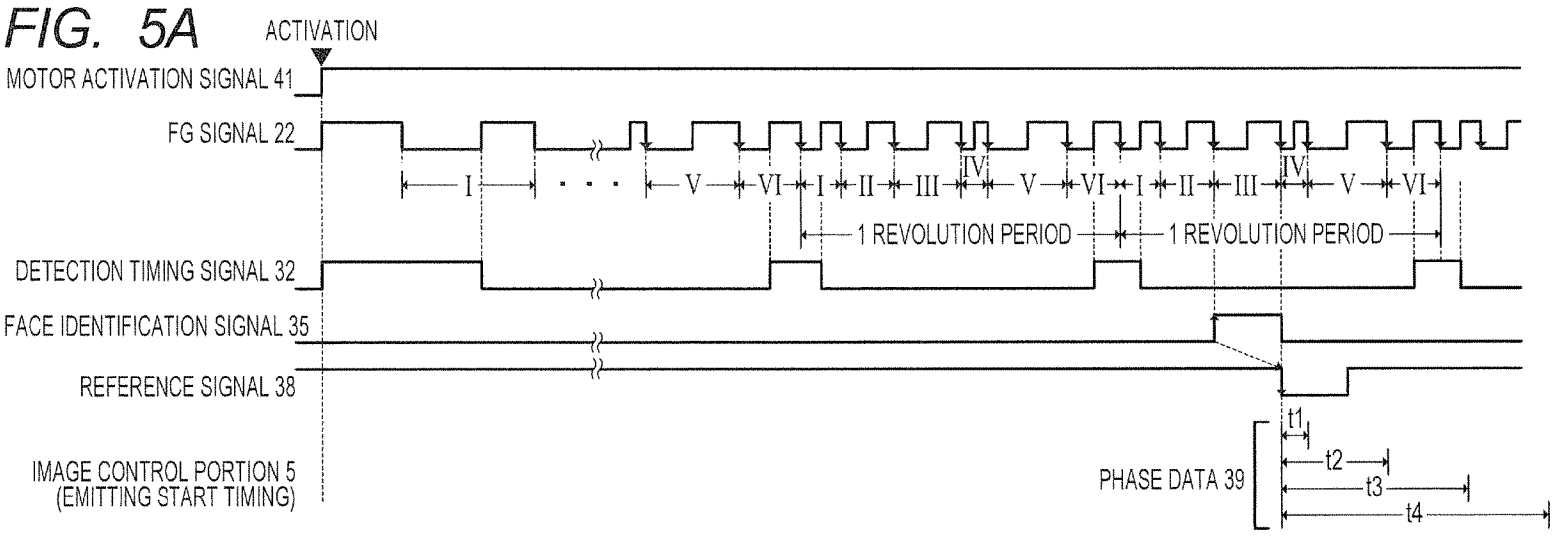
FIG. 5A and FIG. 5B are timing charts for illustrating operations of the writing start control portion according to the third embodiment.
Figure 5B:
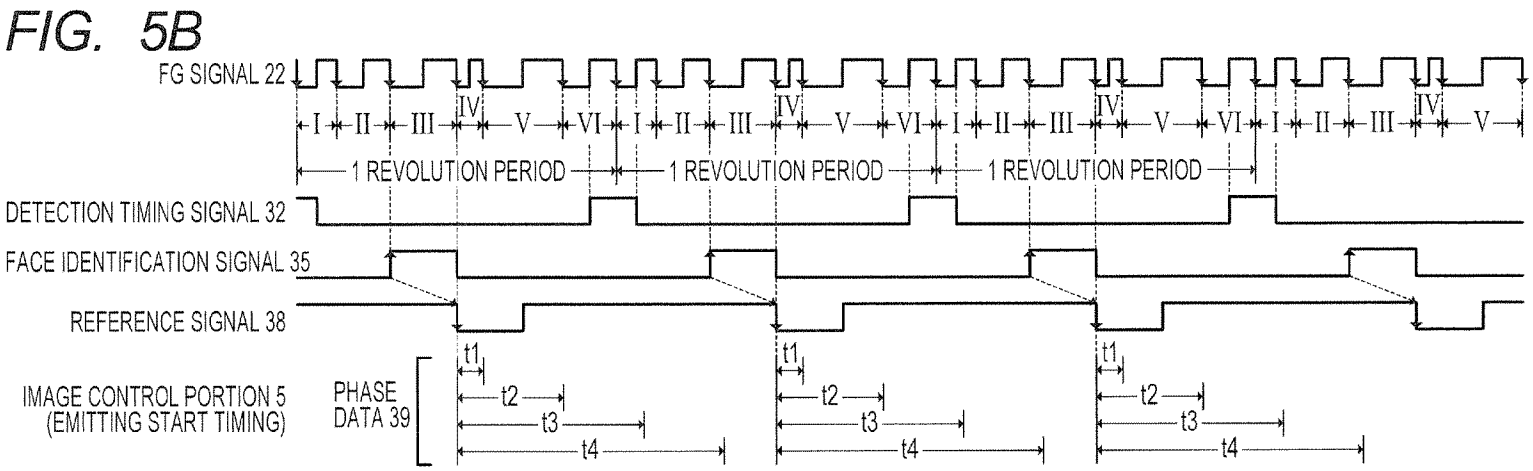

FIG. 5A and FIG. 5B are timing charts for illustrating operations of the writing start control portion 31 according to the third embodiment. FIG. 5A is a timing chart for illustrating an operation immediately after activation of the motor 15. FIG. 5B is a timing chart for illustrating an operation during steady rotation of the motor 15.

The face identifying portion 34 is configured to generate a detection timing signal 32. The detection timing signal 32 is a signal which is output at a predetermined timing once every revolution of the motor 15 with the start of activation of the motor 15 as a starting point. A period of the detection timing signal 32 corresponds to one revolution period of the motor 15. As illustrated in FIG. 5A, the face identifying portion 34 is configured to start measurement for the periods of the FG signals 22 based on the detection timing signals 32. In FIG. 5A, the FG signals 22 start from the magnetic pole position I at the time of activation. However, the start timing differs each time when the motor 15 is activated. The face identifying portion 34 is configured to measure the periods of the FG signals 22 and is capable of identifying the magnetic pole positions I, II, III, IV, V, and VI based on the measured periods. For example, the measured values of the periods of the FG signals 22 are stored in advance as a period pattern in the data storage portion 37 at the time of assembling the light scanning apparatus 2. In the embodiment, the periods of the FG signals 22 are stored as a period pattern in the order of the magnetic pole positions III, IV, V, VI, I, and II in the data storage portion 37. The face identifying portion 34 is configured to measure the periods of the FG signals 22 at the time of image formation, check the measured periods against the period pattern, identify a period of the FG signal 22 matched with a reference value (stored period) of the magnetic pole position III, and generate the face identification signal 35. In the embodiment, the face identification signal 35 identifies that the FG signal 22 having a period matched with the reference value stored in the data storage portion 37 corresponds to the magnetic pole position III. The reference value may represent one period selected from a plurality of periods of the FG signals 22 generated during one revolution of the motor 15 when the motor 15 is rotated at a predetermined rotation speed, or may be a period pattern of the FG signals 22 generated during one revolution of the motor 15. At the time of activation in FIG. 5A, the periods of the FG signals 22 may be fluctuated due to acceleration of the motor 15, and hence the face identification signal 35 is not output. However, as illustrated in FIG. 5B, when the motor 15 is in steady rotation at a predetermined rotation speed, the face identification signals 35 are stably output. According to the embodiment, there is no need to arrange another additional detector in order to identify the reflection surfaces of the rotary polygon mirror 15*a*.

The reference signal generating portion 36 is configured to extract the FG signal 22 at any timing of being synchronized with the face identification signal 35 and generate the reference signal 38. In FIG. 5A and FIG. 5B, for example, the reference signal 38 is output in synchronization with falling of the FG signal 22 after one period of the face identification signal 35.

The data storage portion 37 is configured to store the phase data 39 for determination of the emitting start timing during one revolution of the motor 15. The phase data 39 includes time information (time t1 to time t4) representing respective intervals of the plurality of reflection surfaces of the rotary polygon mirror 15*a* to form a predetermined angle with respect to the reference signal 38. In the case of the rotary polygon mirror 15*a* having four surfaces, four pieces of phase data 39 are stored in the data storage portion 37. The image control portion 5 is configured to determine, based on the reference signal 38 and the phase data 39, the emitting start timing of the light beam for each reflection surface of the rotary polygon mirror 15*a* to keep a writing start position of an image at a fixed position in the main scanning direction. The image control portion 5 sequentially outputs the image signals 40 to the laser control portion 11 at the timings of the phase data 39 with the reference signal 38 as a reference. A method of generating the phase data 39 will be described later.

The writing start control portion 31 is configured to generate the reference signal 38 based on the FG signal 22. The image control portion 5 is configured to determine, based on the reference signal 38 and the phase data 39, the emitting start timing of the light beam to keep a writing start position of an image at a fixed position in the main scanning direction.

(Method of Generating Phase Data)

Figure 6:
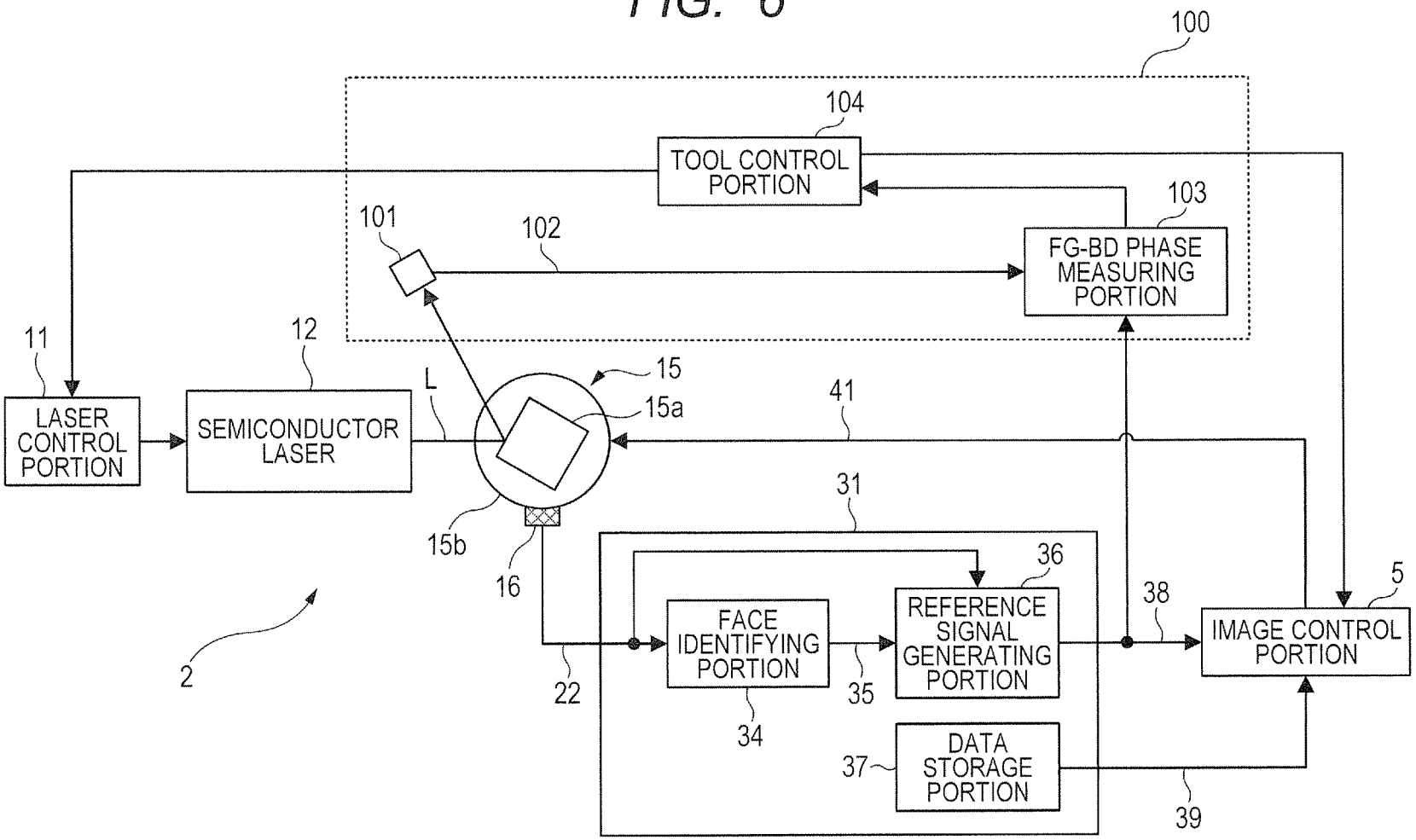
FIG. 6 is a block diagram of a configuration necessary for processing of generating phase data according to the third embodiment.

FIG. 6 is a block diagram of a configuration necessary for processing of generating the phase data 39 according to the third embodiment. The portion surrounded by the broken lines is a tool 100 necessary for assembling of the light scanning apparatus 2. The tool 100 includes a beam detector (hereinafter referred to as "tool BD") 101, an FG-BD phase measuring portion 103, and a tool control portion 104. The tool 100 is arranged with respect to the light scanning apparatus 2 when the phase data 39 is generated in a factory or the like before shipping of the image forming apparatus 1. The tool 100 is removed from the light scanning apparatus 2 after the phase data 39 is generated. The light scanning apparatus 2 can be manufactured in such a manner.

In order to generate the phase data 39, the tool BD 101 is arranged at a position corresponding to the writing start position of an image in the main scanning direction X of the photosensitive drum 25. The tool control portion 104 outputs a motor activation signal 41 from the image control portion 5 to rotate the motor 15. Then, the tool control portion 104 controls the laser control portion 11 arranged in the light scanning apparatus 2 to cause the semiconductor laser 12 to emit light. The light beam L emitted from the semiconductor laser 12 is deflected by the rotary polygon mirror 15*a* and enters the tool BD 101. When the light beam L enters the tool BD 101, the tool BD 101 outputs a beam detection signal (hereinafter referred to as "BD signal") 102. The FG-BD phase measuring portion 103 is configured to measure time differences (phase times) t1, t2, t3, and t4 of the BD signal 102 with respect to the reference signal 38 and output a measurement result to the tool control portion 104.

Figure 7A:
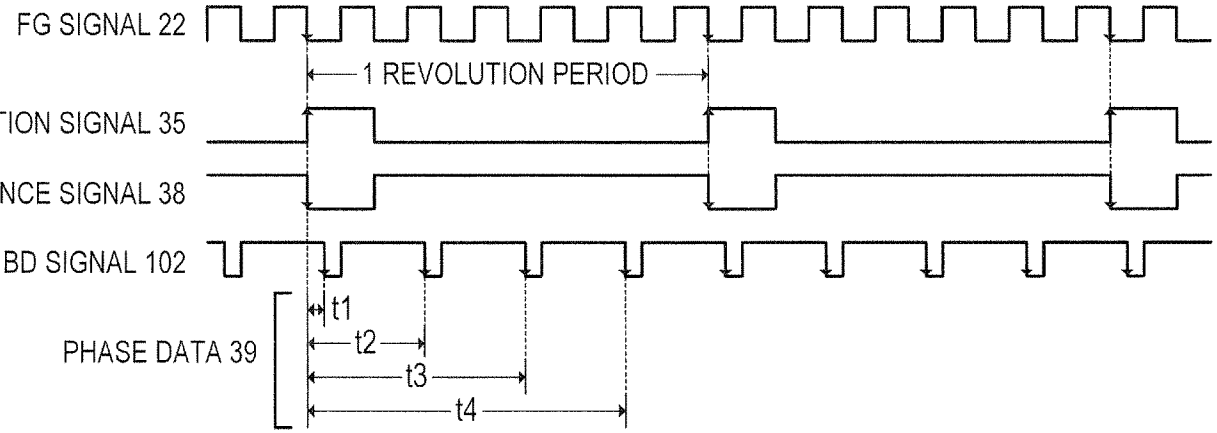
FIG. 7A and FIG. 7B are timing charts for illustrating processing of generating the phase data according to the third embodiment.
Figure 7B:
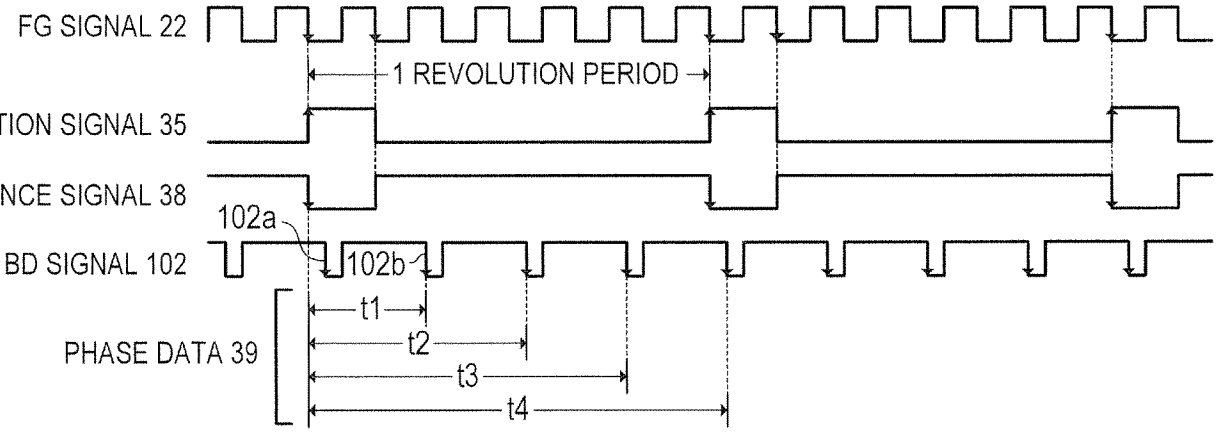

FIG. 7A and FIG. 7B are timing charts for illustrating processing of generating the phase data 39 according to the third embodiment. FIG. 7A and FIG. 7B are each an illustration of a phase relationship between the reference signal 38 and the phase data 39. The phase data 39 is determined based on the reference signal 38 and the BD signal 102. The phase data 39 represents time differences of the BD signals 102 with respect to the reference signal 38. That is, the phase data 39 represents times t1, t2, t3, and t4 from the reference signal 38 to the BD signals 102 corresponding to the reflection surfaces of the rotary polygon mirror 15*a*, respectively. FIG. 7A is an illustration of a case where the BD signal 102 corresponding to the time t1 of the phase data 39 is close to the reference signal 38. In this case, the rotation fluctuation (jitter) of the motor 15 may cause deviation of the FG signal 22 corresponding to the reference signal 38 in the time axis direction. In the case of the phase relationship between the BD signal 102 corresponding to the time t1 and the reference signal 38 illustrated in FIG. 7A, when the timing of generating the FG signal 22 corresponding to the reference signal 38 is fluctuated, a phase between the BD signal 102 corresponding to the time t1 and the reference signal 38 may be inversed. Thus, as illustrated in FIG. 7B, a BD signal 102*b* that is one period after a BD signal 102*a* close to the reference signal 38 may be set as the first time t1 of the phase data 39. With this, an error in the phase data 39 due to the rotation fluctuation (jitter) of the motor 15 can be reduced.

Figure 8:
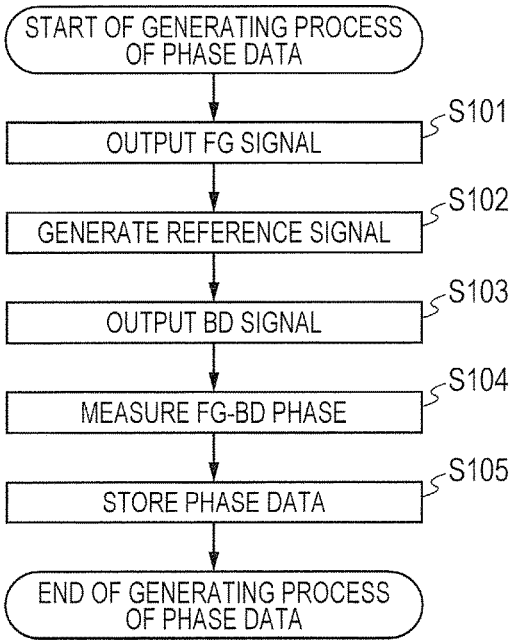
FIG. 8 is a flowchart for illustrating processing of generating the phase data according to the third embodiment.

FIG. 8 is a flowchart for illustrating processing of generating the phase data 39 according to the third embodiment. First, the tool 100 is arranged with respect to the light scanning apparatus 2. As illustrated in FIG. 8, the phase data 39 is generated by the following steps. The tool control portion 104 is configured to execute the processing of generating the phase data 39 in accordance with a program stored in a ROM (not shown). When the processing of generating the phase data 39 is started, the tool control portion 104 causes the motor 15 to rotate, to thereby output the FG signals 22 (S101). The writing start control portion 31 generates the face identification signal 35 based on the FG signal 22 and generates the reference signal 38 based on the face identification signal 35 and the FG signal 22 (S102).

The tool control portion 104 causes the semiconductor laser 12 to emit the light beam L. The light beam L is deflected by the rotary polygon mirror 15*a* and enters the tool BD 101. When the light beam L enters the tool BD 101, the tool BD 101 outputs the BD signal 102 (S103). The FG-BD phase measuring portion 103 measures times t1, t2, t3, and t4 between the reference signal 38 and the BD signals 102 (S104). The tool control portion 104 stores the times (measurement results) t1 to t4 measured by the FG-BD phase measuring portion 103 in the data storage portion 37 as the phase data 39 (S105). The processing of generating the phase data 39 is terminated. After that, the tool 100 is removed from the light scanning apparatus 2.

According to the third embodiment, the emitting start timing can be determined from the reference signal 38 generated based on the FG signal 22 and from the phase data 39 stored in the data storage portion (storage unit) 37. Thus, the emitting start timing is determined with high precision without arrangement of an additional detector, thereby being capable of keeping a writing start position of an image at a fixed position in the main scanning direction.

Fourth Embodiment

Figure 9:
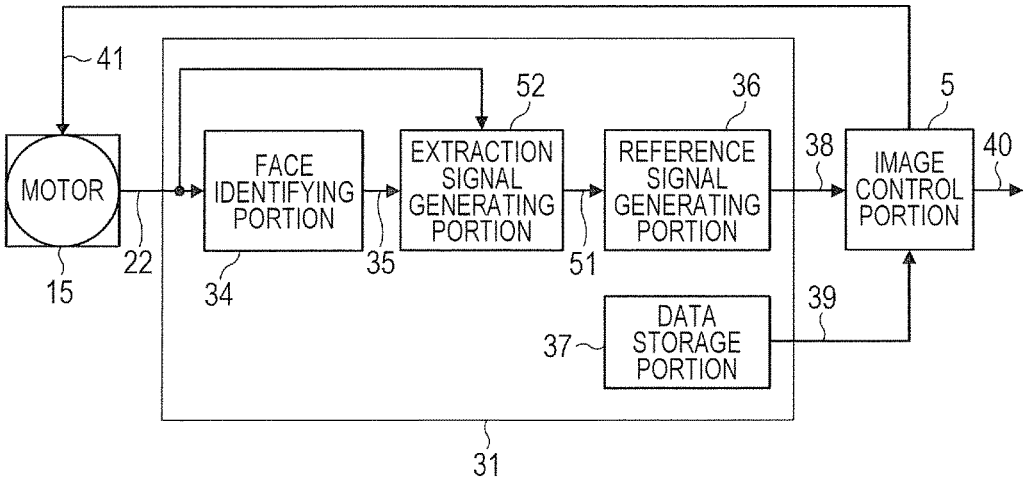
FIG. 9 is a block diagram of the writing start control portion according to a fourth embodiment of the present invention.

Next, a fourth embodiment will be described. In the fourth embodiment, configurations which are the same as those of the first embodiment have the same reference symbols allotted, and description thereof is omitted. The image forming apparatus 1, the motor 15, and the light scanning apparatus 2 according to the fourth embodiment are the same as those of the first embodiment, and hence description thereof is omitted. FIG. 9 is a block diagram of the writing start control portion 31 according to the fourth embodiment. The writing start control portion 31 includes the face identifying portion (identifying unit) 34, an extraction signal generating portion (extraction signal generating unit) 52, the reference signal generating portion (reference signal generating unit) 36, and the data storage portion (storage unit) 37. The motor 15 is configured to rotate in accordance with the motor activation signal 41 output from the image control portion 5, to thereby generate the FG signals 22. The face identifying portion 34 is configured to measure periods of the FG signals 22 and generate the face identification signals 35. The extraction signal generating portion 52 is configured to extract the FG signal 22 at any timing of being synchronized with rising of the face identification signal 35, to thereby generate an extraction signal 51. A period of the extraction signal 51 corresponds to one revolution period of the rotary polygon mirror 15*a*. The reference signal generating portion 36 is configured to generate the reference signal 38 based on the period of the extraction signal 51 through the following calculation method. The data storage portion 37 is configured to store the phase data 39 including phase values of the reflection surfaces of the rotary polygon mirror 15*a* with respect to the reference signal 38. The image control portion 5 is configured to determine the emitting start timing for each surface of the rotary polygon mirror 15*a* from the reference signal 38 and the phase data 39 to keep a writing start position of an image at a fixed position in the main scanning direction. The processing of generating the phase data 39 is the same as that of the third embodiment, and hence description thereof is omitted.

(Reference Signal/Calculation Method)

The reference signal generating portion 36 is configured to measure periods $T_k$ between falling edges of the extraction signal 51 and sequentially determine, based on the calculation results, moving average values of the periods of the extraction signal 51 as presented in Expression 1, Expression 2, and Expression 3. Herein, "k" is an integer. In the embodiment, moving average values of four periods $\tau_k$, $\tau_{k+1}$, $\tau_{k+2}$, and $\tau_{k+3}$ are sequentially determined. The average values of the periods of the extraction signal 51 may be determined by averaging "n" (n≥2) periods of the extraction signal 51. The number of periods of the extraction signal 51 to be averaged and the extraction signal 51 to be used for averaging may be arbitrarily selected.

$$T_1 = \frac{(\tau_1 + \tau_2 + \tau_3 + \tau_4)}{4} \quad \text{Expression 1}$$

$$T_2 = \frac{(\tau_2 + \tau_3 + \tau_4 + \tau_5)}{4} \quad \text{Expression 2}$$

$$T_n = \frac{(\tau_n + \tau_{n+1} + \tau_{n+2} + \tau_{n+3})}{4} \quad \text{Expression 3}$$

Figure 10:
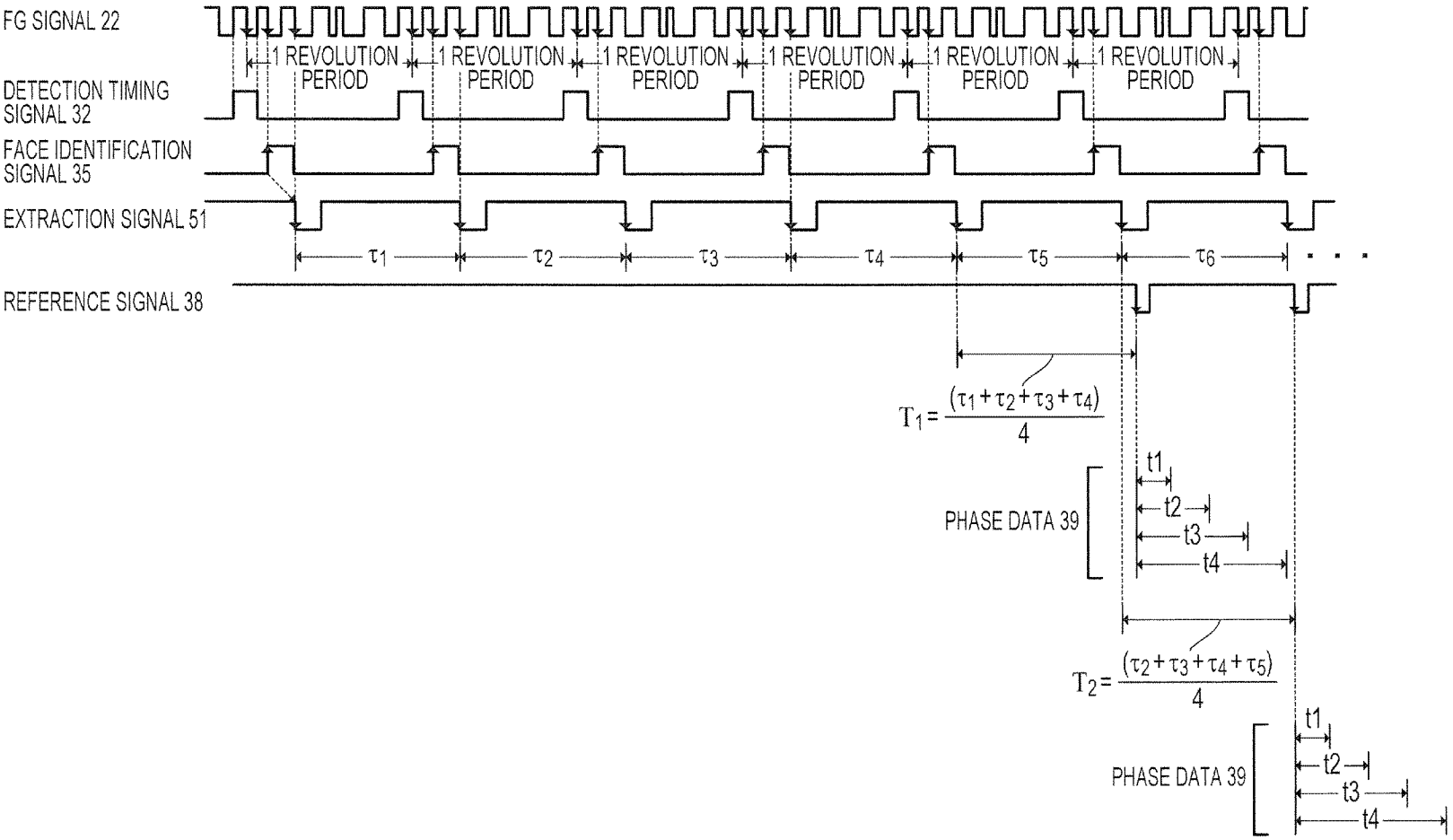
FIG. 10 is a timing chart for illustrating an operation of the writing start control portion according to the fourth embodiment.

FIG. 10 is a timing chart for illustrating an operation of the writing start control portion 31 according to the fourth embodiment. The FG signals 22 are output from the motor 15. The detection timing signals 32 are generated by the face identifying portion 34 at a predetermined timing once every revolution of the motor 15 with the start of activation of the motor 15 as a starting point. The face identifying portion 34 starts measurement for the periods of the FG signals 22 based on the detection timing signals 32. The face identification signals 35 are output from the face identifying portion 34 when the period of the FG signal 22 measured by the face identifying portion 34 matches with a reference value stored in the data storage portion 37. In the embodiment, the face identification signal 35 identifies that the FG signal 22 having a period matched with the reference value stored in the data storage portion 37 corresponds to the magnetic pole position III. The face identification signals 35 and the FG signals 22 are input to the extraction signal generating portion 52. The extraction signal generating portion 52 is configured to extract the FG signal 22 at any timing of being synchronized with the face identification signal 35 and generate the extraction signal 51. The extraction signal 51 is input to the reference signal generating portion 36. The reference signal generating portion 36 is configured to sequentially calculate moving average values ($T_1$, $T_2$, . . . Tn) of the period $\tau_k$ of the extraction signal 51 with the use of Expression 1, Expression 2, and Expression 3. Herein, "n" is an integer. The reference signal generating portion 36 is configured to generate the reference signal 38 at timing of the moving average value ($T_1$, $T_2$, . . . Tn) of the periods $\tau_k$ of the extraction signals 51 with the falling edge of the extraction signal 51 as a starting point. The reference signals 38 and the phase data 39 are input to the image control portion 5. The phase data 39 represents times t1, t2, t3, and t4 output from the data storage portion 37. The image control portion 5 is configured to determine an emitting start timing for each surface of the rotary polygon mirror 15*a* based on the reference signal 38 and the phase data 39 to keep a writing start position of an image at a fixed position in the main scanning direction. The image control portion 5 is configured to sequentially output the image signals 40 to the respective laser control portions 11 for the light scanning apparatus 2*a*, 2*b*, 2*c*, and 2*d* at the timings of the phase data 39 with the reference signal 38 as a starting point.

According to the fourth embodiment, the periods of the FG signals 22 are averaged, and hence an error in the periods of the FG signals due to the jitter of the motor 15 can be reduced. Thus, the emitting start timing is determined with high precision without arrangement of an additional detector, thereby being capable of keeping a writing start position of an image at a fixed position in the main scanning direction.

Fifth Embodiment

Figure 11:
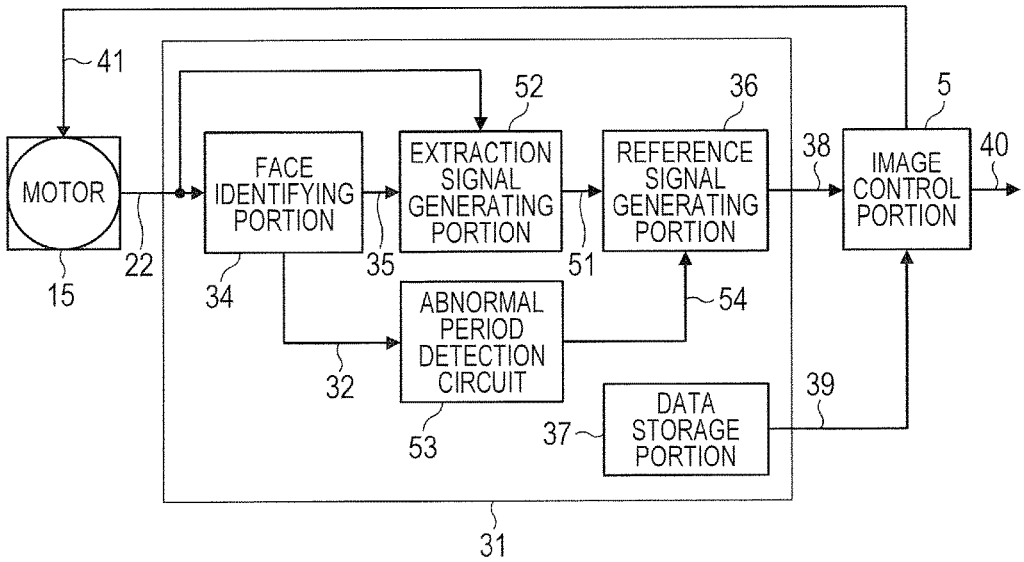
FIG. 11 is a block diagram of the writing start control portion according to a fifth embodiment of the present invention.

Next, a fifth embodiment will be described. In the fifth embodiment, configurations which are the same as those of the first embodiment have the same reference symbols allotted, and description thereof is omitted. The image forming apparatus 1, the motor 15, and the light scanning apparatus 2 according to the fifth embodiment are the same as those of the first embodiment, and hence description thereof is omitted. FIG. 11 is a block diagram of the writing start control portion 31 according to the fifth embodiment. The writing start control portion 31 includes the face identifying portion (identifying unit) 34, the extraction signal generating portion (extraction signal generating unit) 52, the reference signal generating portion (reference signal generating unit) 36, an abnormal period detection circuit (abnormal period detection unit) 53, and the data storage portion (storage unit) 37. The motor 15 is configured to be rotated in accordance with the motor activation signal 41 output from the image control portion 5, to thereby generate the FG signal 22. The face identifying portion 34 is configured to measure periods of the FG signals 22 and generate the face identification signals 35. The face identification signals 35 are input to the extraction signal generating portion 52. The extraction signal generating portion 52 is configured to extract the FG signal 22 at any timing of being synchronized with the face identification signal 35 and generate the extraction signal 51.

Further, the face identifying portion 34 is configured to generate the detection timing signals 32. The detection timing signals 32 are input to the abnormal period detection circuit 53. The abnormal period detection circuit 53 is configured to measure periods of the detection timing signals 32. When a period of the detection timing signal 32 falls outside of a range of thresholds (τerr_max and τerr_min) set in advance in the abnormal period detection circuit 53, the abnormal period detection circuit 53 outputs an abnormality detection signal 54 to the reference signal generating portion 36. When the reference signal generating portion 36 receives the abnormality detection signal 54, the reference signal generating portion 36 removes the extraction signal 51 corresponding to the abnormality detection signal 54. The reference signal generating portion 36 calculates a moving average value of the periods of the extraction signals 51 excluding the extraction signal 51 corresponding to the abnormality detection signal 54. The reference signal generating portion 36 is configured to generate the reference signals 38 based on the extraction signals 51 and the moving average value of the periods of the extraction signals 51. The data storage portion 37 is configured to store the phase data 39 representing phase values of the rotary polygon mirror 15*a* with respect to the reference signal 38. The image control portion 5 is configured to determine an emitting start timing for each surface of the rotary polygon mirror 15*a* from the reference signal 38 and the phase data 39 to keep a writing start position of an image at a fixed position in the main scanning direction. The processing of generating the phase data 39 is the same as that of the third embodiment, and hence description thereof is omitted.

(Abnormal Period Detection Circuit)

Figure 12:
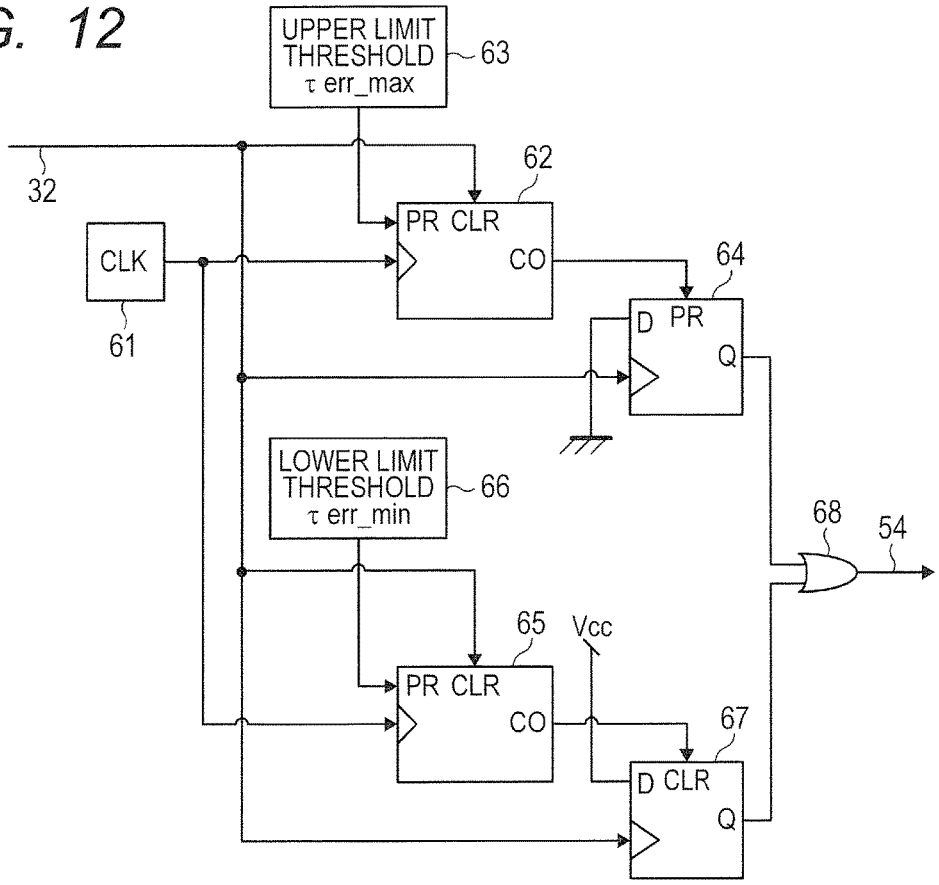
FIG. 12 is a block diagram of an abnormal period detection circuit according to the fifth embodiment.

FIG. 12 is a block diagram of the abnormal period detection circuit 53 according to the fifth embodiment. A first counter 62 and a second counter 65 are configured to count periods of the detection timing signals 32 with the use of a clock (CLK) 61. Thresholds (τerr_max and τerr_min) set in advance are input by preset, and a carry out (carry output, hereinafter referred to as "CO") is output in accordance with a result of counting. A first D-type flip-flop (hereinafter referred to as "first DFF") 64 is configured to output an upper limit abnormality signal when a period of the detection timing signal 32 exceeds the upper limit threshold τerr_max. That is, the first DFF 64 is configured to output an upper limit abnormality signal in accordance with the CO output of the first counter 62 and the detection timing signal 32. A second D-type flip-flop (hereinafter referred to as "second DFF") 67 is configured to output a lower limit abnormality signal when a period of the detection timing signal 32 is equal to or less than the lower limit threshold τerr_min. That is, the second DFF 67 is configured to output a lower limit abnormality signal in accordance with the CO output of the second counter 65 and the detection timing signal 32. The abnormality detection signal 54 is obtained from a result of subjecting the output of the first DFF 64 and the output of the second DFF 67 to a logical sum at an OR gate 68.

Figure 13A:
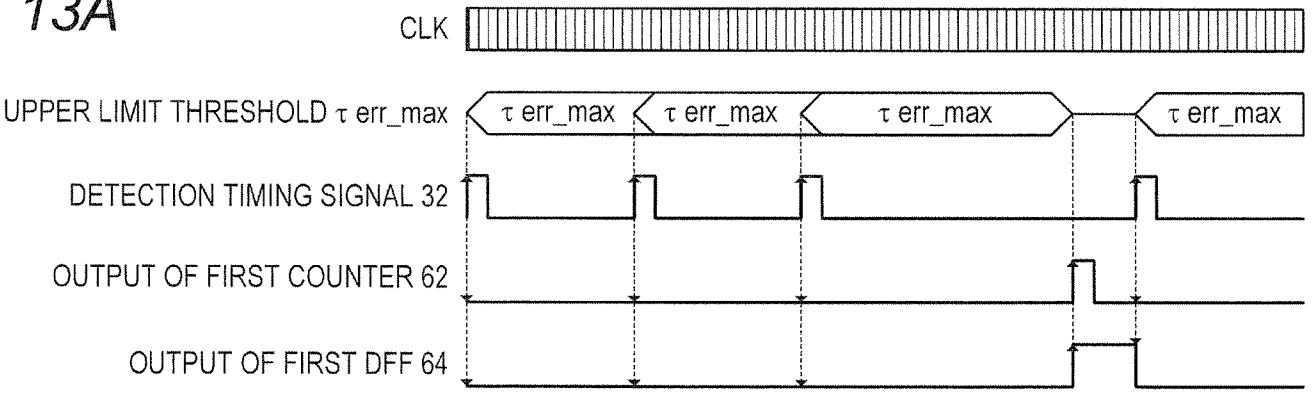
FIG. 13A and FIG. 13B are timing charts for illustrating abnormality of a detection timing signal according to the fifth embodiment.
Figure 13B:
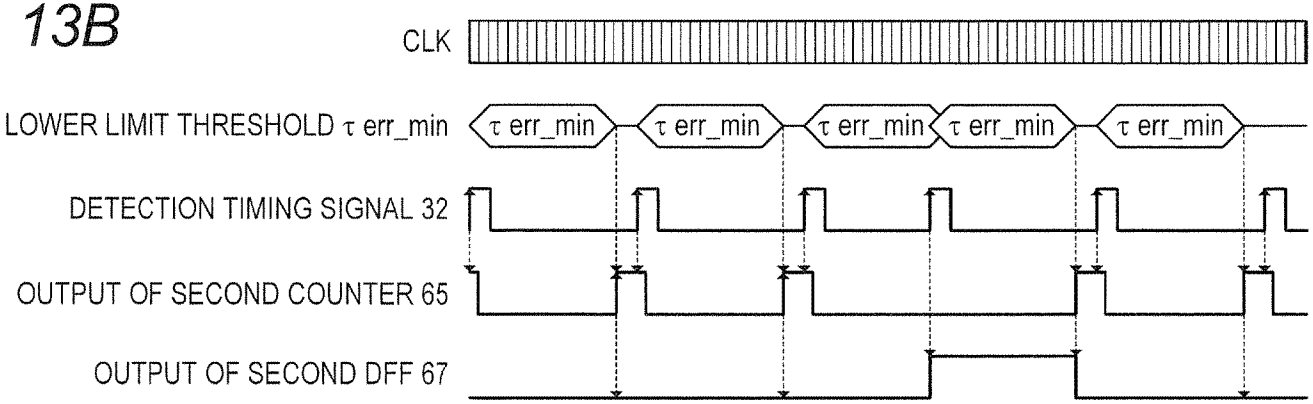

FIG. 13A and FIG. 13B are timing charts for illustrating abnormality of a detection timing signal according to the fifth embodiment. FIG. 13A is a timing chart for illustrating operations of the first counter 62 and the first DEF 64 when a period of the detection timing signal 32 is abnormally extended. The first counter 62 is configured to count the periods of the detection timing signals 32 with the clock (CLK) 61. A count value of the first counter 62 is cleared and reset to zero at each time when the detection timing signal 32 is received. The first counter 62 is configured to determine whether or not the count value is larger than the upper limit threshold (τerr_max) 63. The upper limit threshold (τerr_max) 63 is a value set in advance. The upper limit threshold (τerr_max) 63 is set to be, for example, a value which is longer than a target period by 5% in view of a jitter tolerance of the motor 15. The first counter 62 is configured to reset a counter value for each period of the detection timing signal 32. When the count value is not reset with a value equal to or less than the upper limit threshold (τerr_max) 63, the first counter 62 outputs the CO. That is, when the period of the detection timing signal 32 exceeds the upper limit threshold (τerr_max) 63, the first counter 62 outputs the CO as an abnormal period. The first DFF 64 is configured to output an H-level output voltage when the CO output is input by asynchronous preset. When the CO output is not input by asynchronous preset, the first DEF 64 outputs an L-level output voltage. When the H-level output voltage is input to the OR gate 68, the OR gate 68 outputs an abnormality detection signal 54.

FIG. 13B is a timing chart for illustrating operations of the second counter 65 and the second DEF 67 when the period of the detection timing signal 32 is abnormally shortened. The second counter 65 has the structure which is the same as that of the first counter 62. The second counter 65 is configured to count the periods of the detection timing signals 32 with the clock (CLK) 61. The count value of the second counter 65 is cleared and reset to zero at each time when the detection timing signal 32 is received. The second counter 65 is configured to determine whether or not the count value is larger than the lower limit threshold (τerr_min) 66. The lower limit threshold (τerr_min) 66 is set to a value shorter than a target period by about 5% based on the same idea as the upper limit threshold (τerr_max) 63. The second counter 65 is configured to output the CO as a normal period when the period of the detection timing signal 32 exceeds the lower limit threshold (τerr_min) 66. The second DFF 67 resets the CO output to an asynchronous state in the case of the normal period. When the period of the detection timing signal 32 is not reset with a value equal to or lower than the lower limit threshold (τerr_min) 66, the second DFF 67 outputs an H-level output voltage as the abnormal period. When the H level output voltage is input to the OR gate 68, the OR gate 68 outputs the abnormality detection signal 54.

Figure 14A:
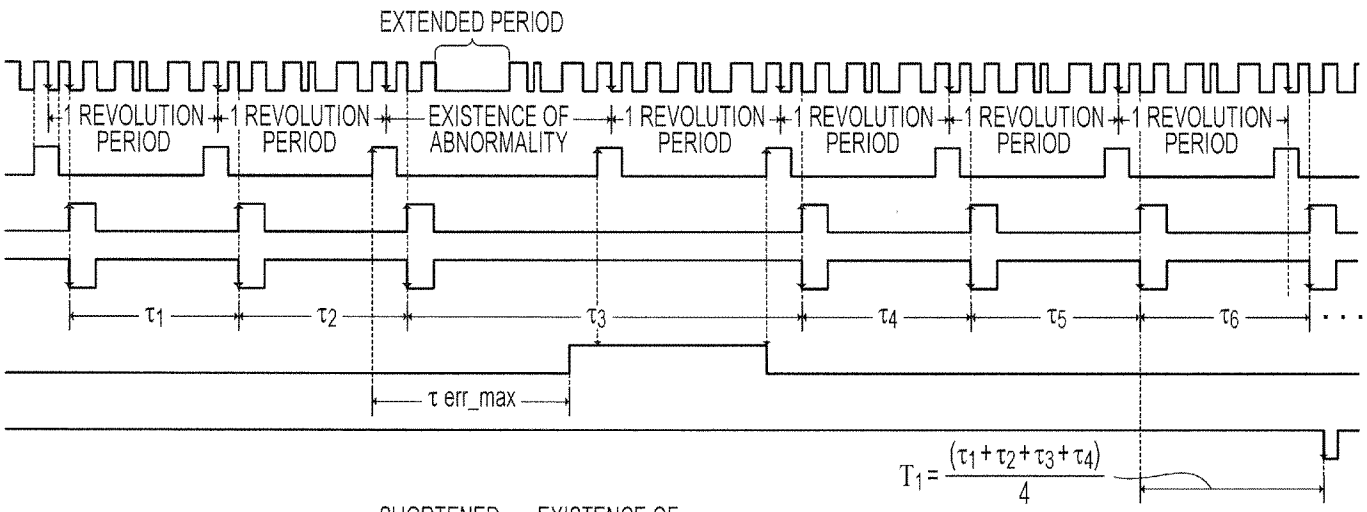
FIG. 14A and FIG. 14B are timing charts for illustrating operations of the writing start control portion according to the fifth embodiment.
Figure 14B:
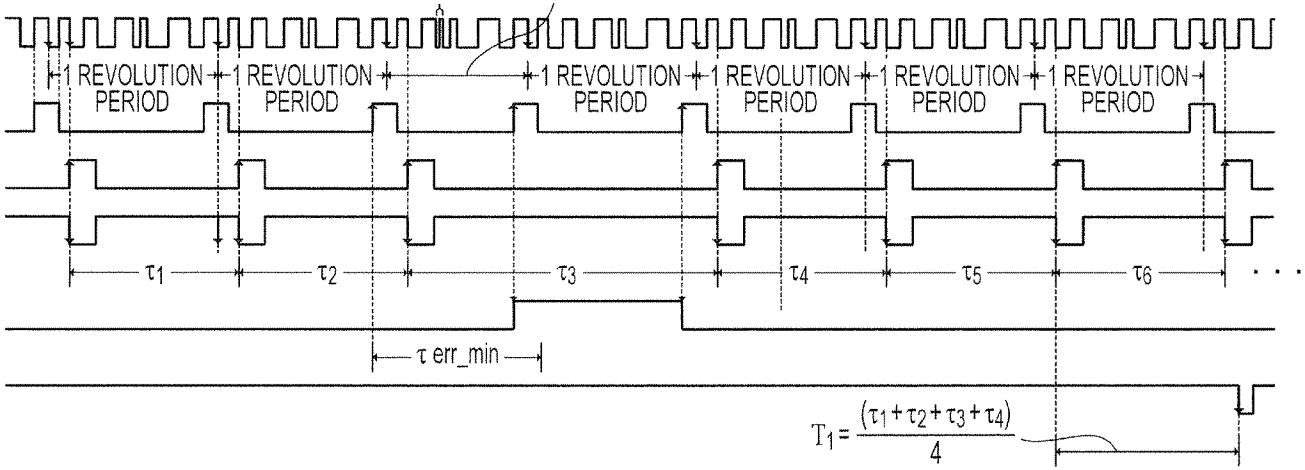

FIG. 14A and FIG. 14B are timing charts for illustrating operations of the writing start control portion 31 according to the fifth embodiment. FIG. 14A is an illustration of the case where a period of the detection timing signal 32 is abnormally extended. FIG. 14B is an illustration of the case where a period of the detection timing signal 32 is abnormally shortened. The face identifying portion 34 starts measurement for periods of the FG signal 22 in accordance with the detection timing signals 32. The face identification signals 35 are signals which are obtained by measuring the periods of the FG signals 22 with the face identifying portion 34 and specifying the FG signal 22 matched with the stored value of the data storage portion 37. The reference signal 38 is output from the reference signal generating portion 36 at a timing of a moving average value ($T_1$, $T_2$, . . . Tn) of the periods of the extraction signals 51 with a falling edge of the extraction signal 51 as a starting point. Meanwhile, when the reference signal generating portion 36 receives the abnormality detection signal 54 from the abnormal period detection circuit 53, the reference signal generating portion 36 outputs the reference signal 38 at a timing of $T_1$ obtained from a sequential moving average of periods excluding a period of the extraction signal 51 corresponding to the abnormality detection signal 54. In the examples illustrated in FIG. 14A and FIG. 14B, abnormality is detected at the period $\tau_3$. In this case, as represented by Expression 4, a moving average value is determined with use of periods $\tau_1$, $\tau_2$, $\tau_4$, and $\tau_5$ excluding the period $\tau_3$.

$$T_1 = \frac{(\tau_1 + \tau_2 + \tau_4 + \tau_5)}{4} \qquad \text{Expression 4}$$

According to the fifth embodiment, abnormal data in the periods of the FG signals 22 is excluded, thereby being capable of reducing an error in a moving average value of the periods. Thus, precision in the emitting start timing to keep a writing start position of an image at a fixed position in the main scanning direction can be further improved.

Sixth Embodiment

Figure 15:
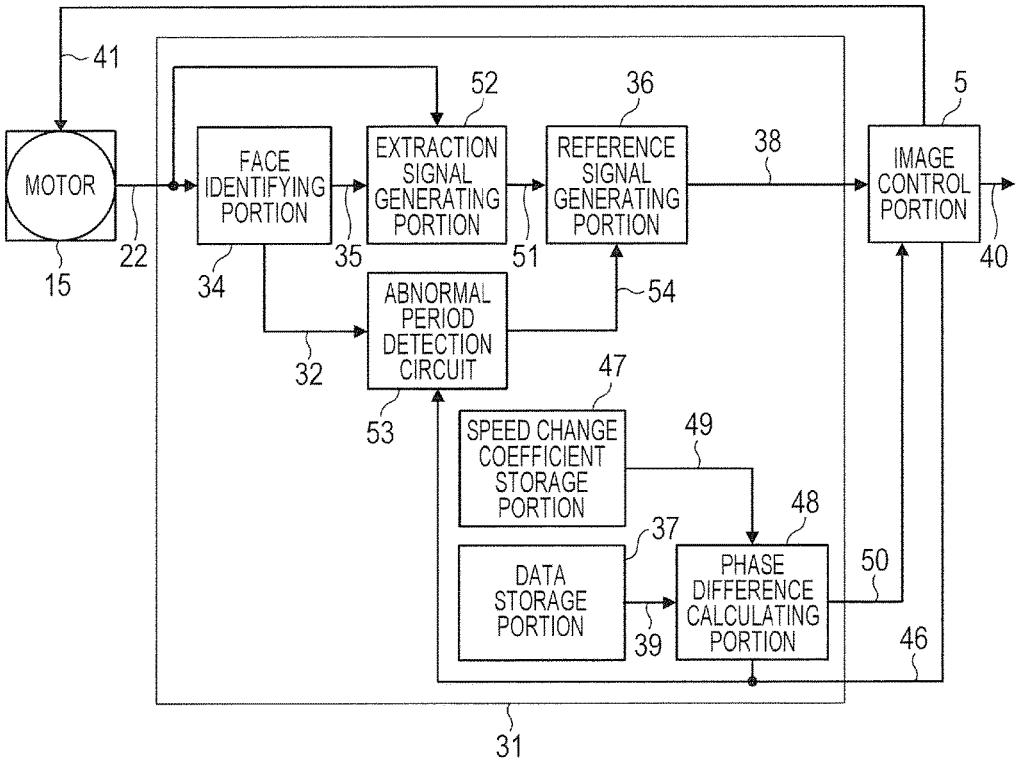
FIG. 15 is a block diagram of the writing start control portion according to a sixth embodiment of the present invention.

Next, a sixth embodiment will be described. In the sixth embodiment, configurations which are the same as those of the first embodiment have the same reference symbols allotted, and description thereof is omitted. The image forming apparatus 1, the motor 15, and the light scanning apparatus 2 according to the sixth embodiment are the same as those of the first embodiment, and hence description thereof is omitted. FIG. 15 is a block diagram of the writing start control portion 31 according to the sixth embodiment. The writing start control portion 31 includes the face identifying portion 34, the extraction signal generating portion 52, the reference signal generating portion (reference signal generating unit) 36, the abnormal period detection circuit 53, the data storage portion 37, a speed change coefficient storage portion (speed change coefficient storage unit) 47, and a phase difference calculating portion (speed change phase data generating unit) 48. The motor 15 is rotated in accordance with the motor activation signal 41 output by the image control portion 5, to thereby generate the FG signals 22. The image control portion 5 is configured to perform activating/stopping control in accordance with the motor activation signal 41, and concurrently output the image signals 40 to the laser control portion 11 in accordance with the speed change phase data 50 with the reference signal 38 output from the writing start control portion 31 as a starting point.

With reference to FIG. 15, the writing start control portion 31 according to the sixth embodiment will be described. The face identifying portion 34 starts measurement for the periods of the FG signals 22 based on the detection timing signals 32. The face identifying portion 34 checks the measured periods of the FG signals 22 against a period pattern stored in advance in the data storage portion 37. The face identifying portion 34 specifies a period of the FG signal 22 matched with the reference value of the period pattern stored in advance in the data storage portion 37 and generates the face identification signal 35. The extraction signal generating portion 52 is configured to extract the FG signal 22 and generate an extraction signal 51 at any timing of being synchronized with rising of the face identification signal 35.

The abnormal period detection circuit 53 is configured to measure the period of the detection timing signal 32. When the period of the detection timing signal falls outside of the range of the threshold (τerr_max and τerr_min) set in advance in the abnormal period detection circuit 53, the abnormal period detection circuit outputs the abnormality detection signal 54 to the reference signal generating portion 36. Meanwhile, when the motor 15 is changed in speed, the image control portion 5 outputs a speed change signal 46 to the abnormal period detection circuit 53. When the abnormal period detection circuit 53 receives the speed change signal 46 from the image control portion 5, the abnormal period detection circuit 53 changes the thresholds (τerr_max and τerr_min) in accordance with the amount of speed change.

When the reference signal generating portion 36 receives the abnormality detection signal 54 from the abnormal period detection circuit 53, the reference signal generating portion 36 excludes the extraction signal 51 corresponding to the abnormality detection signal 54. The reference signal generating portion 36 is configured to calculate a moving average value of the periods of the extraction signals 51 excluding the extraction signal 51 corresponding to the abnormality detection signal 54. The reference signal generating portion 36 is configured to generate the reference signal 38 based on the extraction signals 51 and the moving average value of the periods of the extraction signals 51.

The phase difference calculating portion 48 is configured to calculate speed change phase data 50 from the phase data 39 stored in the data storage portion 37 and a speed change coefficient 49 stored in the speed change coefficient storage portion 47 in accordance with the speed change signal 46 output from the image control portion 5. The speed change phase data 50 is corrected phase data obtained by correcting the phase data 39 based on the speed change coefficient 49. The data storage portion 37 and the speed change coefficient storage portion 47 may be one memory which is, for example, an EEPROM. The image control portion 5 is configured to output the image signals 40 to the respective laser control portions 11 of the light scanning apparatus 2*a*, 2*b*, 2*c*, and 2*d* sequentially at timings of the speed change phase data 50 with the reference signal 38 as a starting point. The processing of generating the phase data 39 is the same as that of the third embodiment, and hence description thereof is omitted.

(Countermeasure to Speed Change of Motor)

Figure 16:
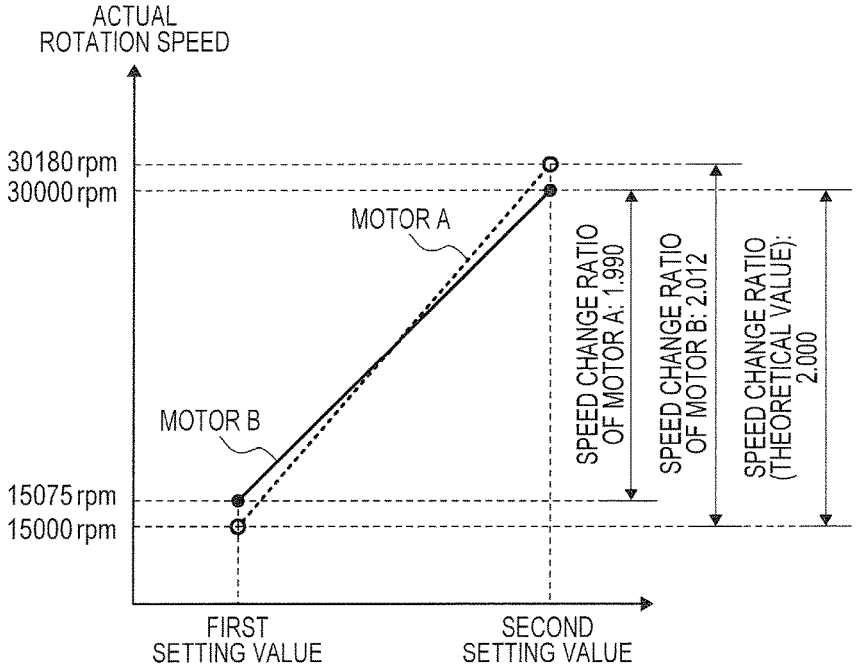
FIG. 16 is a graph for showing a relationship between a rotation speed setting value and an actual rotation speed of a motor according to the sixth embodiment.

Next, countermeasure to a speed change of the motor 15 will be described. FIG. 16 is a graph for showing a relationship between a rotation speed setting value and an actual rotation speed of the motor 15 according to the sixth embodiment. In FIG. 16, there are shown the cases where a motor A and a motor B having the same configuration are rotated at a first setting value of 15,000 rpm and a second setting value of 30,000 rpm. A theoretical value of the speed change coefficient from the first setting value of 15,000 rpm to the second setting value of 30,000 rpm is 2.000. However, the actual rotation speeds of the motor A and the motor B are different from the first setting value of 15,000 rpm and the second setting value of 30,000 rpm due to variance in components or other factors. At the first setting value of 15,000 rpm, the actual rotation speed of the motor A is 15,000 rpm, and the actual rotation speed of the motor B is 15,075 rpm. Further, at the second setting value of 30,000 rpm, the actual rotation speed of the motor A is 30,180 rpm, and the actual rotation speed of the motor B is 30,000 rpm. In this case, the speed change coefficient of the motor A is 1.990 (from 15,075 rpm to 30,000 rpm), whereas the speed change coefficient of the motor B is 2.012 (from 15,000 rpm to 30,180 rpm). It can be seen that there is an error of about 1% between the speed change coefficients of the motor A and the motor B. Herein, the speed change coefficient of the motor represents a ratio of the amount of change in the actual rotation speed with respect to the amount of change in the set rotation speed of the motor.

Figure 17A:
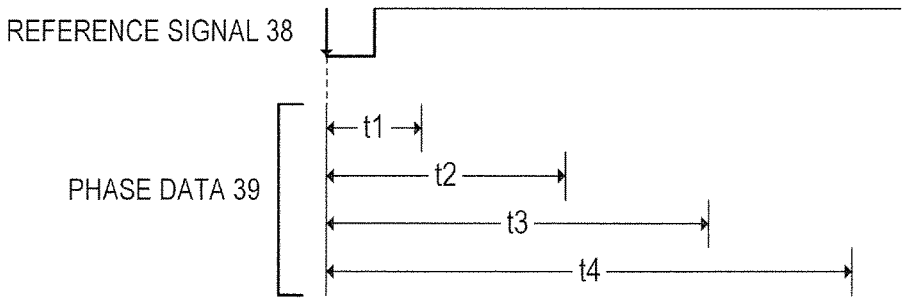
FIG. 17A and FIG. 17B are time charts for illustrating a relationship between a reference signal and phase data according to the sixth embodiment.
Figure 17B:
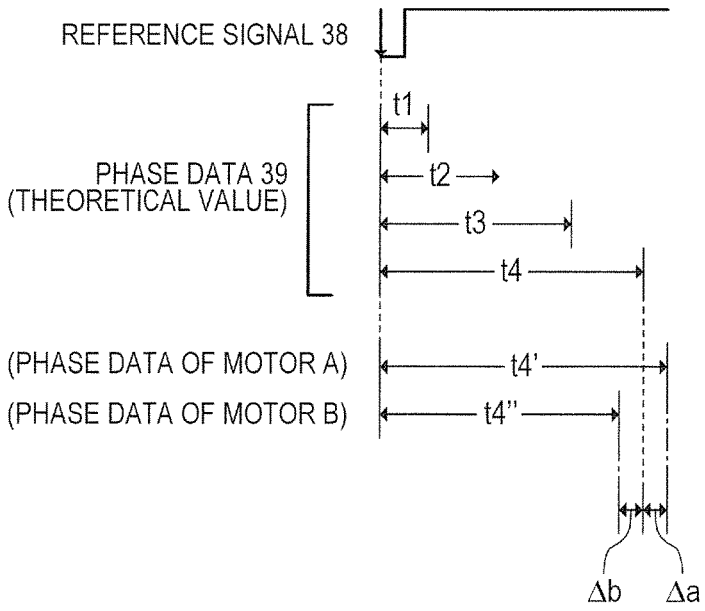

FIG. 17A and FIG. 17B are time charts for illustrating a relationship between the reference signal 38 and the phase data 39 according to the sixth embodiment. FIG. 17A is an illustration of the reference signal 38 and the phase data 39 at the time of 15,000 rpm. FIG. 17B is an illustration of a result of calculation of the phase data 39 at the time of 30,000 rpm from the phase data 39 at the time of 15,000 rpm with use of the reference signal 38, the phase data 39 (theoretical value), and the speed change coefficient at the time of 30,000 rpm. As illustrated in FIG. 17B, it can be seen that the phase data 39 (t4') of the motor A calculated with use of the theoretical value of the speed change coefficient becomes longer than the theoretical value (t4), and that the phase data 39 (t4") of the motor B calculated with use of the theoretical value of the speed change coefficient becomes shorter than the theoretical value (t4). This error in the phase data may lead to degradation of precision in the writing start position. Therefore, in the sixth embodiment, a difference between the setting value of the rotation speed of the motor 15 and the actual rotation speed is measured, and the emitting start timing of the semiconductor laser 12 is changed in accordance with the rotation speed of the motor 15.

Figure 18:
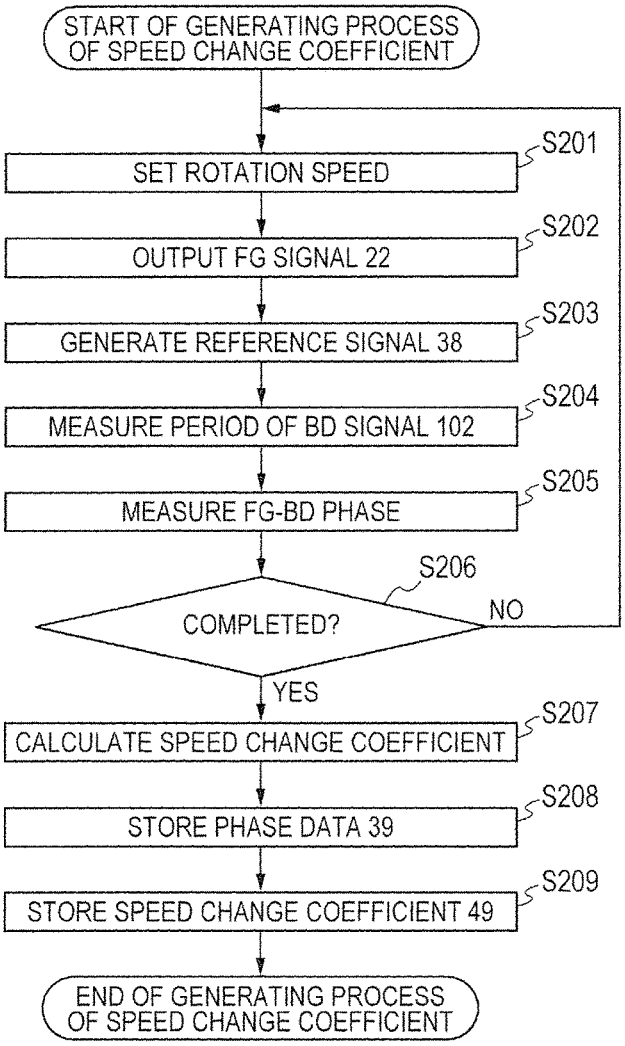
FIG. 18 is a flowchart for illustrating processing of generating a speed change coefficient according to the sixth embodiment.

Specifically, the speed change coefficient of the motor 15 is measured when the light scanning apparatus 2 is assembled, to thereby determine the speed change coefficient 49. The speed change coefficient 49 is to be stored in the speed change coefficient storage portion 47. The tool 100 for use in generating the speed change coefficient 49 is the same as the tool 100 of the third embodiment, and hence description thereof is omitted. FIG. 18 is a flowchart for illustrating processing of generating the speed change coefficient 49 according to the sixth embodiment. The tool control portion 104 is configured to execute the processing of generating the speed change coefficient 49 in accordance with a program stored in a ROM (not shown). When the processing of generating the speed change coefficient 49 is started, the tool control portion 104 sets the rotation speed of the motor 15 (S201). The tool control portion 104 causes the motor 15 to rotate, to thereby output the FG signals 22 (S202). The writing start control portion 31 generates the face identification signal 35 from the FG signal 22, to thereby generate the reference signals 38 (S203).

The tool control portion 104 causes the semiconductor laser 12 to emit the light beam L. The light beam L is deflected by the rotary polygon mirror 15*a* and enters the tool BD 101. When the light beam L enters the tool BD 101, the tool BD 101 outputs BD signals 102. The tool control portion 104 measures periods of the BD signals 102 (S204). The FG-BD phase measuring portion 103 measures times t1, t2, t3, and t4 from the reference signal 38 to the BD signals 102 corresponding to the respective reflection surfaces (S205). The tool control portion 104 determines whether or not the measurement has been completed (S206). When the measurement has not been completed (NO in S206), the processing proceeds to S201, and another rotation speed is set. When the measurement has been completed (YES in S206), the processing proceeds to S207.

The tool control portion 104 calculates the speed change coefficient 49 which is a period ratio from the period of the BD signals 102 obtained through rotation of the motor 15 at a plurality of rotation speeds (S207). The tool control portion 104 stores the measurement result in the FG-BD phase measuring portion 103 as phase data 39 in the data storage portion 37 (S208). The tool control portion 104 stores the speed change coefficient 49 obtained in S207 in the speed change coefficient storage portion 47 (S209). The tool control portion 104 terminates the processing of generating the speed change coefficient 49.

According to the sixth embodiment, at the time of speed change of the motor 15, the emitting start timing is determined based on the speed change coefficient 49 memorized in advance, and hence the precision in the image writing start position in the main scanning direction can be improved regardless of the variance in the motor 15.

In the embodiment, the image forming apparatus 1 configured to form a color image is described. However, the present invention is also applicable to an image forming apparatus configured to form a monochromatic image.

According to the embodiment, the emitting start timing of the light beam can be determined based on the FG signals 22 output from the motor 15 without addition of another detector. Therefore, the cost for the light scanning apparatus can be reduced.

According to the above described embodiments, the emitting start timing of the light beam can be determined based on the rotational position detection signals generated in accordance with rotation of the motor configured to rotate the rotary polygon mirror.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-178208, filed Sep. 10, 2015, which is hereby incorporated by reference herein in its entirety.

What is claimed is:

1. A light scanning apparatus, comprising:

a light source configured to emit a light beam;

a rotary polygon mirror configured to deflect the light beam emitted from the light source so that the light beam scans on a surface of a photosensitive member in a main scanning direction;

a motor configured to rotate the rotary polygon mirror; and a rotational position detection unit configured to detect a magnetic flux change caused by rotation of the motor to generate a rotational position detection signal, wherein an emitting start timing of the light beam from the light source is determined based on the rotational position detection signal in order to maintain a writing start position of the light beam with respect to the photosensitive member in the main scanning direction.

2. A light scanning apparatus according to claim 1, further comprising a memory configured to memorize a reference value of the rotational position detection signal when the motor is rotated at a predetermined rotation speed, wherein the emitting start timing is determined based on the reference value and the rotational position detection signal generated by the rotational position detection unit.

3. A light scanning apparatus according to claim 2, further comprising:

a reference signal generating unit configured to generate a reference signal based on the reference value and the rotational position detection signal; and a storage unit configured to store phase data of a plurality of reflection surfaces of the rotary polygon mirror with respect to the reference signal, wherein the emitting start timing is determined based on the reference signal and the phase data.

4. A light scanning apparatus according to claim 3, further comprising:

a speed change coefficient storage unit configured to store a speed change coefficient representing a ratio of an amount of change in an actual rotation speed with respect to an amount of change in a set rotation speed of the motor; and a speed change phase data generating unit configured to generate speed change data by correcting the phase data based on the speed change coefficient, wherein the emitting start timing is determined based on the reference signal and the speed change phase data.

5. A light scanning apparatus according to claim 3, further comprising an extraction signal generating unit configured to generate an extraction signal having a period corresponding to one revolution period of the rotary polygon mirror based on the rotational position detection signal and the reference value, wherein the reference signal generating unit is configured to generate the reference signal based on an average value of n periods of the extraction signal, where $n \geq 2$.

6. A light scanning apparatus according to claim 5, further comprising an abnormal period detection unit configured to detect abnormality in the period of the extraction signal to generate an abnormality detection signal, wherein the reference signal generating unit is configured to obtain the average value excluding a period of an extraction signal corresponding to the abnormality detection signal.

7. An image forming apparatus, comprising:

a photosensitive member;

a charging unit configured to charge the photosensitive member;

a light scanning apparatus configured to emit a light beam to form an electrostatic latent image on a surface of the photosensitive member; and a developing unit configured to develop the electrostatic latent image to form a toner image, which is to be transferred onto a recording medium, on the surface of the photosensitive member, the light scanning apparatus comprising:

a light source configured to emit the light beam;

a rotary polygon mirror configured to deflect the light beam emitted from the light source so that the light beam scans on the surface of the photosensitive member in a main scanning direction;

a motor configured to rotate the rotary polygon mirror; and a rotational position detection unit configured to detect a magnetic flux change caused by rotation of the motor to generate a rotational position detection signal, wherein an emitting start timing of the light beam from the light source is determined based on the rotational position detection signal in order to maintain a writing start position of the light beam with respect to the photosensitive member in the main scanning direction.

8. A method of manufacturing a light scanning apparatus, the light scanning apparatus comprising:

a light source configured to emit a light beam;

a rotary polygon mirror configured to deflect the light beam emitted from the light source so that the light beam is scanned on a surface of a photosensitive member in a main scanning direction;

a motor configured to rotate the rotary polygon mirror; and a rotational position detection unit configured to detect a magnetic flux change caused by rotation of the motor to generate a rotational position detection signal, the method comprising:

arranging a tool including a beam detector, a phase measuring portion, and a control portion with respect to the light scanning apparatus;

rotating the motor to generate the rotational position detection signal;

memorizing, in a memory, a reference value representing one period selected from a plurality of periods of the rotational position detection signal during one revolution of the motor when the motor is rotated at a predetermined rotation speed; and removing the tool from the light scanning apparatus.

9. A method according to claim 8, further comprising:

generating a reference signal based on the rotational position detection signal and the reference value;

generating phase data of a plurality of reflection surfaces of the rotary polygon mirror with respect to the reference signal; and storing the phase data in a storage unit.

10. A method according to claim 8, further comprising:

generating a speed change coefficient representing a ratio of an amount of change in an actual rotation speed with respect to an amount of change in a set rotation speed of the motor; and storing the speed change coefficient in a speed change coefficient storage unit.

* * * * *